US005462229A

United States Patent [19]

Tanaka et al.

[11] Patent Number: 5,462,229

[45] Date of Patent: Oct. 31, 1995

[54] STEAM INJECTOR

[75] Inventors: Nobuhiko Tanaka; Tadashi Narabayashi, both of Yokohama; Hiroshi Miyano, Kamakura; Hideaki Takahashi, Tokyo; Katsumi Yamada, Fujisawa; Makoto Yasuda, Yokohama, all of Japan

[73] Assignee: Kabushiki Kaisha Toshiba, Kawasaki, Japan

[21] Appl. No.: 216,608

[22] Filed: Mar. 23, 1994

Related U.S. Application Data

[62] Division of Ser. No. 943,760, Sep. 11, 1992, Pat. No. 5,323,967.

[30] Foreign Application Priority Data

| | | | |
|---|---|---|---|
| Sep. 13, 1991 | [JP] | Japan | 3-234707 |
| Sep. 19, 1991 | [JP] | Japan | 3-239346 |
| Oct. 30, 1991 | [JP] | Japan | 3-284924 |

[51] Int. Cl.[6] ..... B05B 7/04; B05B 7/00

[52] U.S. Cl. ..... 239/397.5; 239/434.5

[58] Field of Search ..... 239/434.5, 416, 239/416.5, 417, 601, 397.5, 132

[56] References Cited

U.S. PATENT DOCUMENTS

| | | | |
|---|---|---|---|
| 1,508,010 | 9/1924 | Circle | 239/434.5 |
| 1,660,557 | 2/1928 | Heimburger | 239/434.5 |
| 2,013,302 | 9/1935 | Ferguson | 239/434.5 |
| 2,660,125 | 11/1953 | Frese | 239/434.5 |
| 3,688,511 | 9/1972 | Harmstrof | 239/434.5 |
| 4,555,059 | 11/1985 | Collins et al. | 239/434.5 |
| 4,688,724 | 8/1987 | Pal et al. | 239/434.5 |

*Primary Examiner*—Andres Kashnikow

*Attorney, Agent, or Firm*—Oblon, Spivak, McClelland, Maier, & Neustadt

[57] ABSTRACT

A steam injector includes a casing having a water supply port and a steam intake port, the casing being generally composed of two halves fastened integrally, a water nozzle and a steam nozzle both disposed in the casing and communicated with the water supply port and the steam intake port, respectively, a steam-water mixing nozzle disposed on the downstream side in the casing and a diffuser disposed further downstream side in the casing. The steam injector further includes a guide member such as guide vane or spacer ring for guiding the steam to the steam-water mixing nozzle. The steam injector may includes a needle valve disposed in a steam jetting nozzle, disposed axially in the central portion of the casing, which is provided with a heat transfer preventing structure such as hollow wall structure provided on the outer peripheral surface of the steam jetting nozzle. The water nozzle may be composed of a wear resisting material and the wear resisting material may be provided on the surfaces of the steam jetting nozzle and the diffuser.

4 Claims, 20 Drawing Sheets

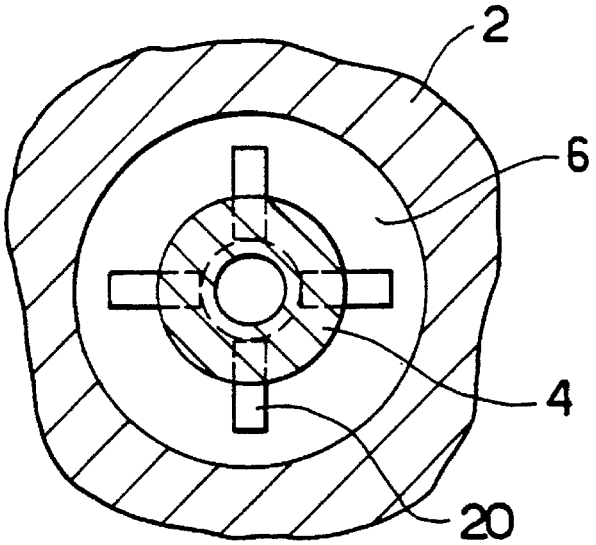
FIG. 3
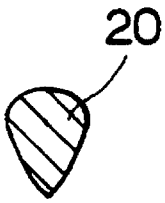
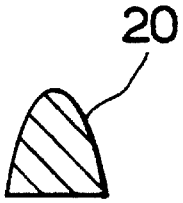
FIG. 4A FIG. 4B

STEAM INJECTOR

This is a division of application Ser. No. 07/943,760, filed on Sep. 11, 1992, now U.S. Pat. No. 5,323,967.

BACKGROUND OF THE INVENTION

1. Field of the Invention

The present invention relates to a steam injector for jetting highly pressurized water adapted to a boiler water supply particularly utilized for a water supply system in an emergency core cooling system such as light water reactor.

2. Discussion of the Background

A steam injector is generally utilized for a water supply system in a steam locomotive or a boiler of one type in which steam flows in its central region or another type in which water flows in its central region.

First, with reference to FIG. 25, one type of steam injector in which steam flows in its central region will be described. Namely, the steam injector shown in FIG. 25 has a casing 302 provided with a steam intake port 301, and a steam jetting nozzle 304 provided with a needle valve 303. The front, right hand as viewed, end of the steam jetting nozzle 304 is positioned near a water suction port 305. A steam-water mixing nozzle 306 and a pressure increasing diffuser 307 are arranged on a downstream side of the steam jetting nozzle 304, which are communicated with a discharge port 309 through a check valve 308. The steam-water mixing nozzle 306 is provided with a throat portion 310 to which an overflow discharge port 312 communicating with an overflow water duct 311 is opened, which is otherwise closed in accordance with an operation.

In the steam injector of the structure described above, when the needle valve 303 is drawn out from the steam jetting nozzle 304 by operation of a handle 313 connected to one end, i.e. the left hand end as viewed, of the needle valve 303 and the steam taken into from the steam intake port 301 is hence jetted from the steam jetting nozzle 304, the pressure at the water suction port 305 is made negative by the condensation of the steam to a value below atmospheric pressure and the water is sucked from a tank or the like. The steam flows, while being condensed by a low-temperature water (less than 70° C.) sucked from the water suction port 305, into the steam-water mixing nozzle 306 and then constitutes a downstream water flow at the throat portion 310.

Namely, because the enthalpy $\eta_g$ of the steam is higher than the enthalpy $\eta_l$ of a saturated water by an amount corresponding to latent heat of evaporation, the latent heat evaporation is converted into a kinetic energy to thereby form a high velocity water flow. When this high velocity water flow passes the diffuser 307, the pressure is increased by an amount of ΔP shown in the following equation in accordance with a hydrodynamic theory.

$$\Delta P=(1/2)\rho_w U_t^2$$

($\rho_w$=water density and $U_t$=flow velocity of high velocity water flow passing the throat portion)

According to this equation, a discharge pressure higher than the steam supply pressure can be obtained by the steam injector. When the pressure on the outlet side of the diffuser 307 is sufficiently increased, the check valve 308 is automatically opened to thereby jet the pressurized water through the discharge port 309.

However, in the steam injector of the structure described above, only the discharge pressure of about 7 kg/cm$^2$G could be obtained, and such discharge pressure is a value which can merely be utilized for a boiler of a steam locomotive. It is considered that the cause of such limited low pressure increase resides in the fact that the longitudinal, i.e. axial, sectional area of the steam jetting nozzle 304 is made small or narrow towards the front end thereof.

Various attempts and studies have been carried out for increasing the discharge pressure utilized for the steam injector for an emergency core cooling system. FIG. 26 also shows a conventional example provided on the basis of these various attempts and studies.

The steam injector shown in FIG. 26 has substantially the identical structure to that of FIG. 25, but it is not provided with a needle valve such as that needle valve 303 in FIG. 25. Namely, the steam injector has a structure such as a diffuser having a gradually increased inner diameter towards the downstream side of the steam to thereby obtain a supersonic steam flow. A second nozzle is further located at the discharge side of the steam-water mixing nozzle 306 and the overflow discharge port 312 is formed on the upstream side of the throat portion 310. According to the steam injector of this structure, it is possible to obtain a discharge pressure of an amount about six or more times of the steam injector shown in FIG. 25.

As described above, in the steam injector, the steam is mixed with the low-temperature water to thereby condense the steam, the thus released latent heat of evaporation is converted into the kinetic energy and then into the pressure energy to obtain highly pressurized water. Accordingly, for the operation of the steam injector, it is necessary for the water to be supplied to have a temperature being sufficiently low to the extent capable of condensing the steam, and usually, the water has a temperature lower by about more than 70° C. than the steam saturation temperature. For example, when the steam injector is operated in atmospheric pressure, it is necessary to use water having a temperature of less than 30° C. because of the steam saturation temperature of 100° C.

As is apparent from the structures of the steam injectors and the operational principles, it is desired to have a large temperature difference between the steam and the water at a time of being contacted with each other. However, in the described conventional structures, the heat of the steam is transferred to the water through the wall of the steam injection nozzle, so that the temperature of the water is made high in comparison with the water temperature of the water at the time of being supplied, thus the temperature difference is small. Furthermore, since the heat of the steam in the steam jetting nozzle is released, a portion of the steam is condensed, thus reducing its volume, resulting in lowering of the flow velocity of the steam. According to these reasons. the efficiency of the steam injector is itself reduced, and in an adverse case, the steam injector may stop operation.

Furthermore, in the steam injector which is not incorporated with the needle valve, there is provided a problem of causing pulsation of the discharge pressure variable in a short period. In the case of application of the steam injector to a nuclear power plant, the oscillation caused by the pressure pulsation may adversely affect the steam injector itself and the other equipment or lines, and therefore, it is required to reduce such pressure pulsation for ensuring stable operation of the nuclear power plant.

Since the pressure pulsation of the steam injecter is caused by the fact that the steam is not stably condensed, it is necessary for the reduction of the pressure pulsation to facilitate condensation of the steam and to carry out continuous reaction. In order to achieve this purpose, it is considered to be effective to increase the contacting area between the steam and the water. The contacting area between the steam and the water may be determined by the hydraulic equivalent diameter of the front end of the water nozzle. The hydraulic equivalent diameter corresponds to a value obtained by dividing the cross sectional area of the water nozzle port by the wetted perimeter length, and the contacting area can be increased by making this value small.

However, since the the cross sectional area is determined by the capacity of the steam injector, in the conventional round-type nozzle in which the wetted perimeter length naturally corresponds to the peripheral length of the water nozzle port, the cross sectional area is also naturally determined. Accordingly, it may be said that the increasing of the contacting area between the steam flow and the water flow has a restricted limit.

FIGS. 27 and 28 further show other examples of the steam injectors of the prior art each in which the water flows through the central region of the steam injector. FIG. 27 represents a horizontal type and FIG. 28 represents a vertical type, but both of these steam injectors have basically similar structures. That is, in the steam injector shown in FIG. 28, a water nozzle 316 is incorporated in a body 315 connected to the casing 302 and a needle valve 303 is inserted into the water nozzle 316, wherein the pressure of the steam is increased together with a steam from an adjacent steam suction port by a steam-water mixing nozzle 306 disposed on the downstream side of the water nozzle 316. The steam injector shown in FIG. 28 has substantially the same structure as that of FIG. 27 but it is not provided with the needle valve.

In the case where the conventional steam injectors are utilized as emergency water supply systems, the operation condition and the pressure are deemed as variable factors which balance conditions on the water supply side, so that it is necessary for the injector side to reach a rated pressure as soon as possible and to maintain a stable operation for a long time. Furthermore, it is desirable to control the startup characteristic from the operation free from a complicated control system. Moreover, in the case of the steam injector being utilized as a fluid driving source, it is necessary for the steam injector to keep stable the jetting condition.

In the conventional structure of the steam injector, there is a case in which the jetting condition of the steam injector reaches the rated power in a certain time interval just after the operation of the steam injector and the jetting pressure lowers as the time passes thereafter. This is considered to be based on the deformation between the steam nozzle and the mixing nozzle due to temperature variation and pressure variation on the periods of the waiting condition and the operating condition. Accordingly, suppression of such deformation will result in improvement of the operational characteristics.

Although adjustments of the flow rate and the pressure may be varied with the location of the needle valve, the performance of the steam injector is significantly affected by the positional relationship between the steam nozzle and the steam-water mixing nozzle and it is hence necessary to keep this positional relationship most suitable. However, in the conventional steam injectors, the operating temperatures differ from each other since at the starting time they are at a normal temperature and at during operation they are at a high temperature. This temperature difference results in the change of the positional relationship, which adversely affects on the originally expected performance.

Furthermore, in the conventional steam injectors in each of which the needle valve is provided, and the needle valve is shifted to adjust and change the flow area of the water supply nozzle to attain the optimum discharge power, the flow areas of the steam are rapidly contracted at the steam jetting nozzle portion, thereby causing the supersonic steam flow. For this reason, there may be caused wear, due to the supersonic steam flow, to the outer wall surface of the water supply nozzle forming the steam jetting nozzle portion and to the inner wall surface of the casing of the steam injector, and furthermore, there is caused an errosion of at an area of the wall surface of the throat portion positioned downstream side of the steam jetting nozzle portion by the high velocity water flow, thus causing the wear to this portion.

As described, when the wear to the respective wall portions progresses, the flow area itself changes, and hence, the balance of the flow rates of the water and the steam changes gradually, resulting in degradation of the performance of the steam injector. With respect to the steam-water mixing nozzle, it becomes difficult to ensure stable condensation of the steam.

These problems are also made significant for the water supply device of an emergency core cooling system of a power plant, for example, which requires high reliability and performance.

SUMMARY OF THE INVENTION

An object of the present invention is to substantially eliminate defects or drawbacks encountered in the prior art and to provide a steam injector capable of constantly maintaining the positional relationship between a steam-water mixing nozzle and a water nozzle and a steam jetting nozzle in any operational condition and hence operating the steam injector stably and safely.

Another object of the present invention is to provide a steam injector having a structure capable of maintaining a necessary or constant flow passage area of the steam.

A further object of the present invention is to provide a steam injector having a structure capable of preventing structural parts or elements of the steam injector from being deformed.

A still further object of the present invention is to provide a steam injector having a structure capable of preventing heat transfer from the steam to the water.

A still further object. of the present invention is to provide a steam injector having a structure capable of substantially reducing a pressure pulsation of the steam.

A still further object of the present invention is to provide a steam injector having a wear resisting structure capable of preventing the parts or elements of the steam injector from being worn down and having high performance and reliability.

These and other objects can be achieved according to the present invention by providing, in one aspect, a steam injector comprising:

- a casing provided with a steam intake port and a water supply port;
- a steam nozzle disposed inside the casing and communicated with the steam intake port for introducing steam into the casing;
- a water nozzle disposed inside the casing and communicated with the water supply port for introducing water into the casing;
- a steam-water mixing nozzle disposed inside the casing and on a downstream side of the steam nozzle and the water nozzle;

a diffuser disposed inside the casing and on a downstream side of the steam-water mixing nozzle, the diffuser being provided with a throat portion;

guide means for unitarily combining the steam nozzle, the water nozzle and the steam-water mixing nozzle to keep constant the relative positional relationships among these nozzles; and a discharge port formed in the casing on a downstream side of the diffuser.

The guide means comprises a plurality of guide vanes disposed in the casing along a circumferential direction of the steam-water nozzle. The guide means may comprise a spacer ring disposed between the water nozzle and the steam-water mixing nozzle and provided with a plurality of flow passages.

The steam injector may further comprise a steam jetting nozzle disposed inside the casing so as to axially extend therein and have a front end facing the steam-water mixing nozzle and a needle valve disposed in the steam jetting nozzle so as to be axially movable therein.

In another aspect of the present invention, there is provided a steam injector comprising:

a casing provided with a steam intake port and a water supply port;

a steam nozzle disposed inside the casing and communicated with the steam intake port for introducing steam into the casing;

a water nozzle disposed inside the casing and communicated with the water supply port for introducing water into the casing;

a steam-water mixing nozzle disposed inside the casing on a downstream side of the water nozzle and the steam nozzle;

a steam jetting nozzle disposed inside the casing so as to extend axially therein;

a diffuser disposed inside the casing and on a downstream side of the steam jetting nozzle, the diffuser being provided with a throat portion;

a member for controlling thermal expansions of the steam jetting nozzle and the steam-water mixing nozzle to keep constant the relative positional relationship between these nozzles; and a discharge port formed in the casing on a downstream side of the diffuser.

The control member may be composed of a control rib integrally formed to the steam-water jetting nozzle and the control rib is formed of a material having a thermal expansion coefficient larger than that of the steam-water nozzle.

In a further aspect of the present invention, there is provided a steam injector comprising:

a casing provided with a steam intake port and a water supply port:

a steam nozzle disposed inside the casing and communicated with the steam intake port for introducing steam into the casing;

a water nozzle disposed inside the casing and communicated with the water supply port for introducing water into the casing;

a steam-water mixing nozzle disposed inside the casing and on a downstream side of the steam nozzle and the water nozzle;

a steam jetting nozzle disposed inside the casing so as to extend axially therein and have a front end facing the steam-water mixing nozzle;

a member disposed to an outer peripheral portion of the steam jetting nozzle for preventing heat transfer;

a diffuser disposed inside the casing and on a downstream side of the steam jetting nozzle, the diffuser being provided with a throat portion; and a discharge port formed in the casing on a downstream side of the diffuser.

The heat transfer preventing member is composed a double wall structure disposed to the outer peripheral portion of the steam jetting nozzle, and the means may be composed of a wall structure formed of a material having a heat insulation property such as a ceramic.

In a still further aspect of the present invention, there is provided a steam injector comprising:

a casing provided with a steam intake port and a water supply port;

a steam nozzle disposed inside the casing and communicated with the steam intake port for introducing steam into the casing;

a water nozzle disposed inside the casing and communicated with the water supply port for introducing water into the casing;

a steam-water mixing nozzle disposed inside the casing and on a downstream side of the steam nozzle and the water nozzle;

a steam jetting nozzle disposed inside the casing so as to extend axially therein and have a front end facing the steam-water mixing nozzle;

a diffuser disposed inside the casing and on a downstream side of the steam jetting nozzle, the diffuser being provided with a throat portion; and a discharge port formed in the casing on a downstream side of the diffuser, the water nozzle being disposed inside the steam jetting nozzle, the water nozzle having front end with respect to a flow of water, and the front end being formed so as to reduce a hydraulic equivalent diameter.

The front end of the water nozzle is formed in a star-like shape in a plan view so as to increase a surface area contacting the steam. The front end may be formed in a porous structure so as to increase a surface area contacting the steam.

In a still further aspect of the present invention, there is provided a steam injector comprising:

a casing provided with a steam intake port and a water supply port;

a steam nozzle disposed inside the casing and communicated with the steam intake port for introducing steam into the casing;

a water nozzle disposed inside the casing and communicated with the water supply port for introducing water into the casing;

a steam-water mixing nozzle disposed inside the casing and on a downstream side of the steam nozzle and the water nozzle;

a steam jetting nozzle disposed inside the casing between said casing and the water nozzle;

a diffuser disposed inside the casing and on a downstream side of the steam jetting nozzle, the diffuser being provided with a throat portion;

a wear resisting structure formed to outer surfaces of the steam-water nozzle and the diffuser; and a discharge port formed in the casing on a downstream side of the diffuser.

The wear resisting structure is a wall structure formed of a wear resisting material.

According to the characters or structures of the present invention described above in various aspects, the present invention can attain the following functions and effects.

In one aspect, the water nozzle and the steam-water mixing nozzle are unitarily assembled, so that the relative positional relationships among the steam flow-in portion, the water flow-in portion and the steam-water mixing portion can be accurately set in accordance with the desired design. Furthermore, the positional relationships can be substantially constantly maintained without being influenced with an operational change or temperature change. Particularly, with respect to the water nozzle, since one end there of is formed as a free end, a free extension may be allowed, and in such a case, the separation of the water from steam can be performed by the location of the seal ring.

The guide means such as guide vane is formed so as to have a streamline shape, so that the pressure loss at this portion can be reduced. The mixing degree of the water and the steam can be facilitated by forming the guide vane in a reverse streamline shape.

In another aspect, since the control member such as control rib having a thermal expansion coefficient larger than a material forming the steam-water mixing nozzle is incorporated in the steam-water mixing nozzle, the deformation of elements or parts in the casing of the steam injector caused by the temperature or pressure difference can be minimized, thus improving the performance and reliability of the steam injector.

In a further aspect, since the steam jetting nozzle is provided with a heat insulation structure, the heat transfer through the wall of the steam jetting nozzle can be minimized, thus preventing heat transfer from the steam to the water and hence preventing minimally the steam condensation and raising for water temperature. Furthermore, the flow velocity of the steam and the water temperature can be suitably maintained, thus being effective. Since the temperature difference at the mixing time of the steam and the water can be made large, the operation can thus be stabilized.

In a further aspect, the water jetting portion of the water nozzle is formed so as to have an increased surface area, so that the condensation of the steam can be facilitated, whereby the dischage water flow can be stabilized and pressure pulsation can be reduced.

In a still further aspect, wear of the wall surfaces of elements or portions disposed inside the casing due to the supersonic flow of the steam jetted from the steam jetting nozzle can be alleviated, whereby the degradation of wall surfaces of the various portions due to the temperature fatigue at the steam-water mixing portion can be substantially suppressed and abrasion due to the errosion at the throat portion of the diffuser can be also alleviated, thus keeping a good flow balance of the steam and the water and hence keeping optimal the operational performance of the steam injector.

Further objects, features and advantages of the present invention will be clarified by the following descriptions made with reference to the accompanying drawings.

BRIEF DESCRIPTION OF THE DRAWINGS

In the accompanying drawings:

FIG. 3 is a sectional view taken along the line III—III of FIG. 2;

FIGS. 4A and 4B are sectional views taken along the line IV—IV of FIG. 2 showing different embodiments of the guide vane;

DESCRIPTION OF THE PREFERRED EMBODIMENTS

A first preferred embodiment of the present invention will be described hereunder with reference to FIGS. 1 to 4B in which detailed explanations or descriptions of the elements or members corresponding to those shown in FIGS. 25 to 28 are omitted herein. Further, in these FIGS. 1 to 4B, solid arrows denote the steam flow directions and dotted arrows denote the water flow directions.

Figure 28:
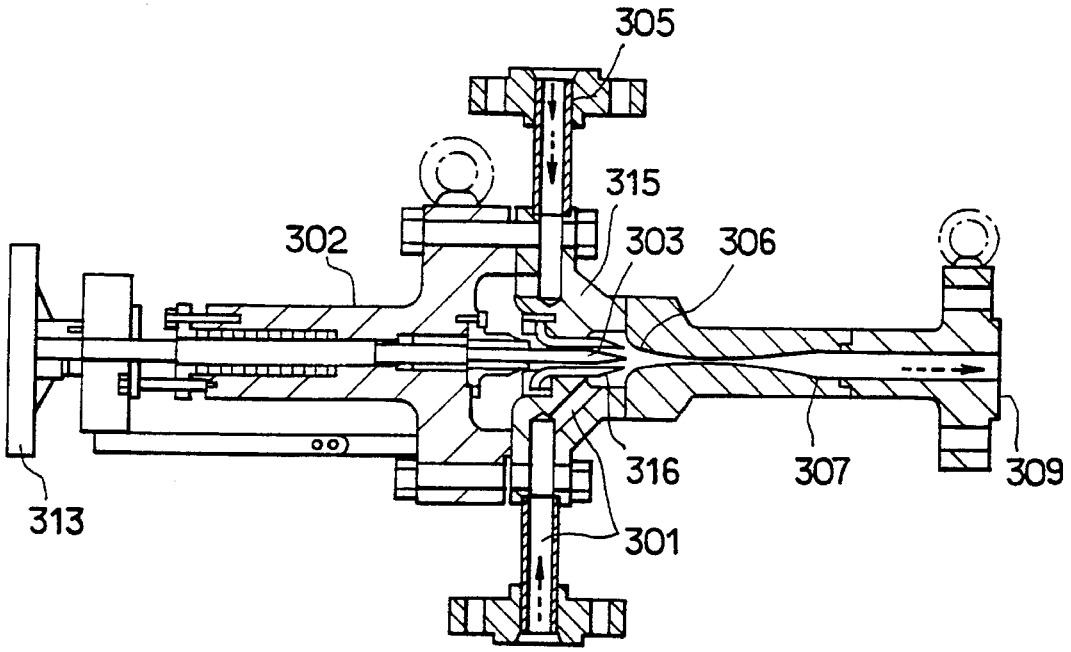
FIG. 28 PRIOR ART

The steam injector of the first embodiment relates to a type corresponding to the steam injector of FIG. 28, in which a water nozzle is arranged at substantially the central portion of the steam injector. Referring in FIG. 1, a steam intake port 1 is formed to a body 15 connected to a casing 2 and a water nozzle 16 is incorporated in the body 15 at substantially the central portion thereof. The body 15 is constructed as a portion of the casing 2 and connected thereto by means of bolt and nut assembly.

Figure 1:
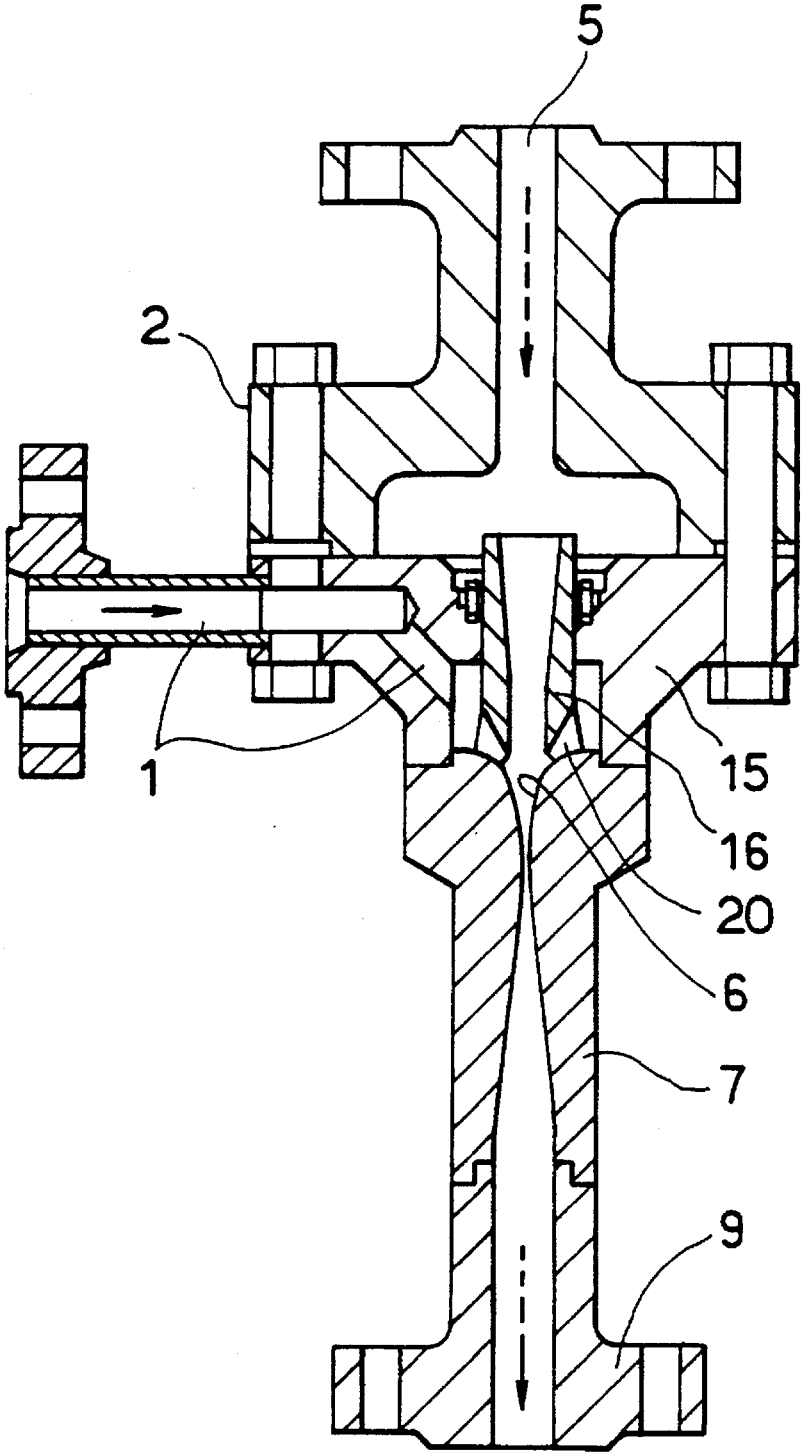
FIG. 1 shows an elevational section of a first embodiment of a steam injector according to the present invention.
Figure 2:
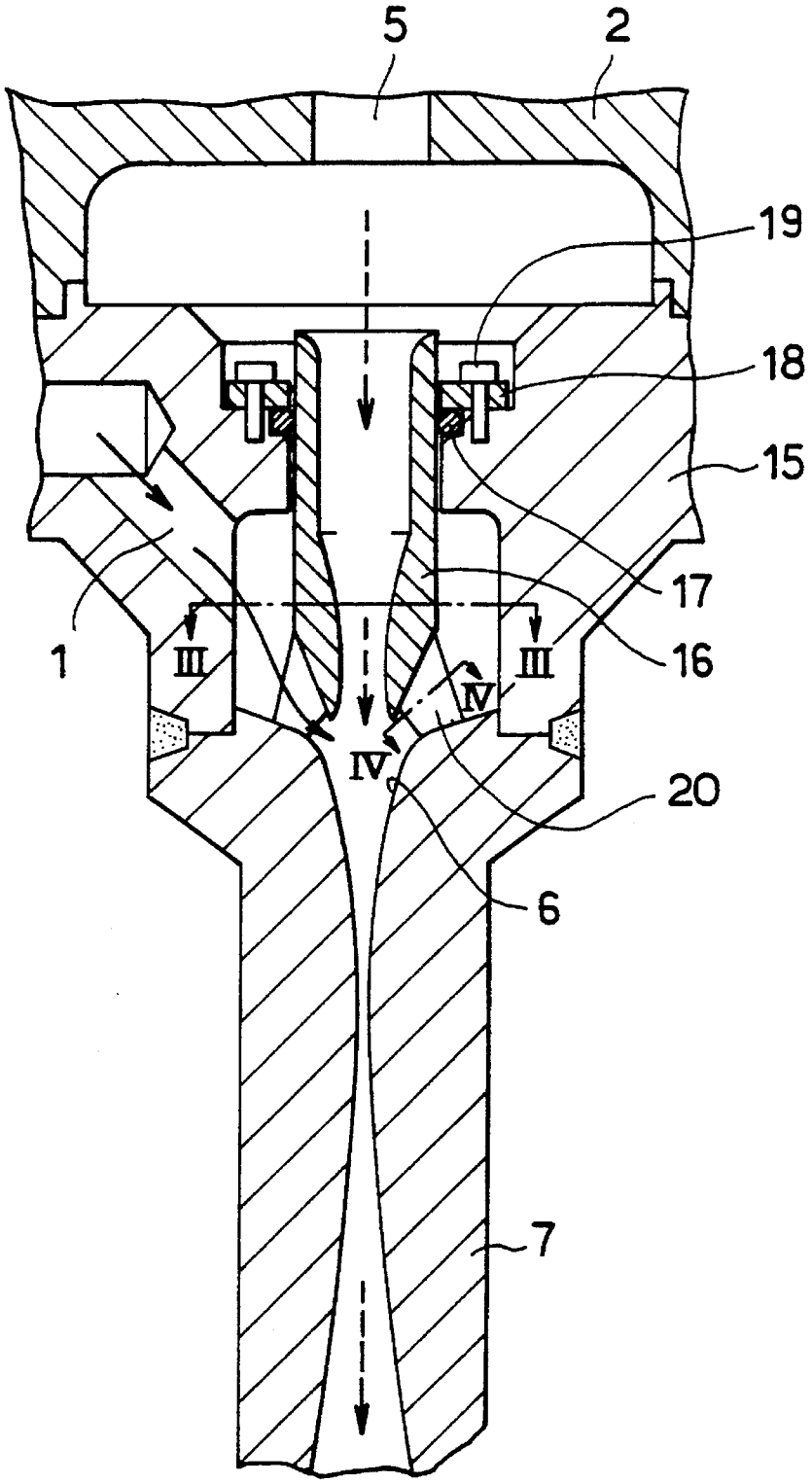
FIG. 2 is an elevational section of an inner main portion, in an enlarged scale, of a casing of the steam injector of FIG. 1.

A water suction port 5 or passage is formed to the inner central portion Of the casing 2 so as to penetrate therethrough to thereby communicate with the water nozzle 16. In an illustrated vertical state, a diffuser 7 is welded to the lower surface portion of the body 15. A steam-water mixing nozzle 6 is formed in the diffuser 7 at an upstream side thereof and a discharge port 9 is also formed at a downstream side of the diffuser 7. As shown in FIG. 2 as an enlarged view, sealing of the water nozzle with respect to the body 15 is maintained by a seal ring 17, which is fastened to the body 15 by means of bolts 19 through a press plate 18. A guide vane 20 is interposed along a circumferential direction between the front end, i.e. downstream end, of the water nozzle 16 and an inlet port of the steam-water mixing nozzle 6.

In the first embodiment of the structure described above, the water nozzle 16 is connected to the steam-water mixing nozzle 6 and coupled thereto through a plurality of guide vanes 20 to thereby integrate the water nozzle 6, the guide vanes 20 and the steam-water mixing nozzle 16. It is desired to effect surface treatment to the surfaces of these structural elements to reduce the surface roughness.

The seal ring 17 disposed at substantially the central portion of the body 15 attains a function for separating the water flown from the water nozzle 16 from the steam from the steam intake port 1. As shown in FIG. 2 or FIG. 4A, it is desired for the guide vane 20 to have a streamline shape to make smooth the flow or to have a reversed streamline shape as shown in FIG. 4B. On the contrary, the shape of the guide vane 20 may be formed to the shape reverse to the above for facilitating the mixing degree of the steam and water in the steam-water mixing area.

According to this first embodiment, the relative position between the water nozzle 16, the steam intake port 1 and the steam-water mixing nozzle 6 is fixed irrespective of specified conditions to achieve stable performance of the steam injector. Furthermore, the reduction of the pressure loss can result in improvement of the performance of the steam injector, and the mixing efficiency can be also improved by intentionally causing turbulent flow of the steam.

Figure 5:
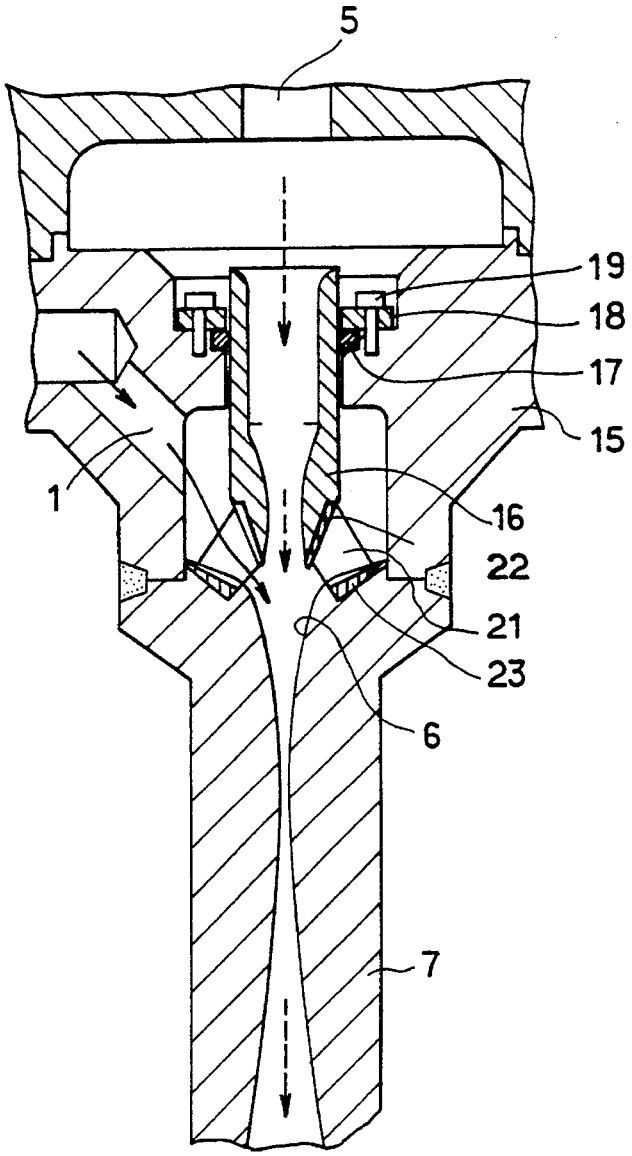
FIG. 5 is an elevational section similar to that of FIG. 2, but is related to a second embodiment according to the present invention.
Figure 6:
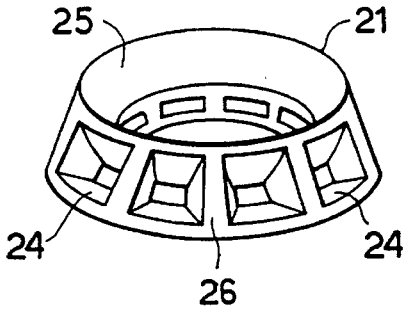
FIG. 6 is a perspective view of a spacer ring disposed in the steam injector of FIG. 5.

A second embodiment of the steam injector according to the present invention will be described hereunder with reference to FIGS. 5 and 6, in which like reference numerals are added to portions or elements corresponding to those in the first embodiment.

One main difference of the second embodiment from the first embodiment resides in the location of a spacer ring 21 in place of the guide vanes 20. An outer appearance is shown in FIG. 6 in a perspective view. As shown in FIG. 6, the spacer ring 21 has a frustconical body having an upper, as viewed, portion having a diameter smaller than that of the lower portion and has an inclined or tapered side surface to which a plurality of flow passages 24 are formed. Reference numeral 25 denotes an inner surface of the body of the spacer ring 21 formed as an abutting surface against the water nozzle 16 and reference numeral 26 denotes an outer surface of the body formed as an abutting surface against the steam-water mixing nozzle 6. The spacer ring 21 of the structure described is fitted, at its water nozzle side, into a side groove 22 formed to an outer periphery of the front portion of the water nozzle 16 and fitted, at its steam-water mixing nozzle side, into a side groove 23 formed to an upper surface of the steam-water mixing nozzle 6, and then fixed to these groove portions by welding means, for example.

According to the second embodiment, the water nozzle or the steam jetting nozzle 4 and the steam-water mixing nozzle 6 can be separately manufactured and these structures can be thereafter connected through the spacer ring 21 to constantly maintain the flow passage, and furthermore, the manufacturing of such spacer ring 21 can be optionally made in accordance with the design conditions or requirement.

Figure 7:
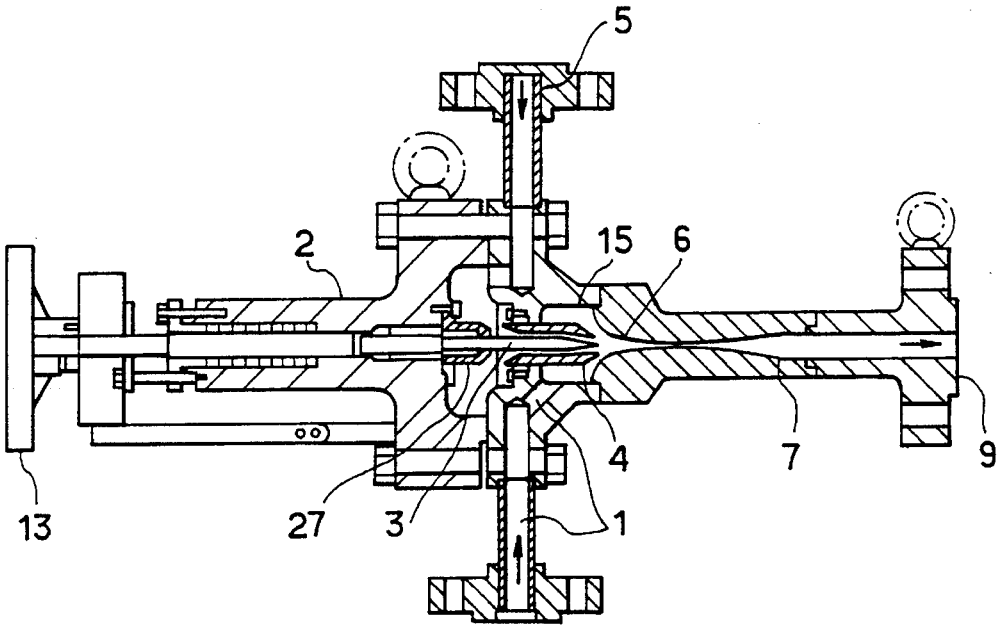
FIG. 7 is a longitudinal section of a third embodiment of a steam injector according to the present invention.
Figure 8:
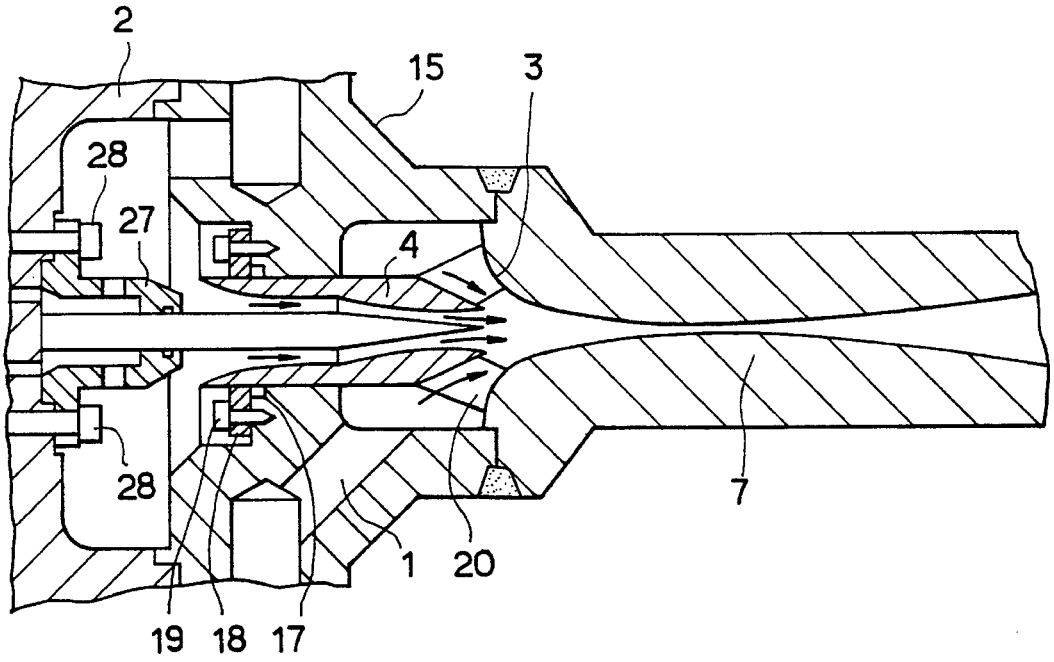
FIG. 8 is a longitudinal section of an inner main portion, in an enlarged scale, of a casing of the steam injector of FIG. 7.
Figure 9:
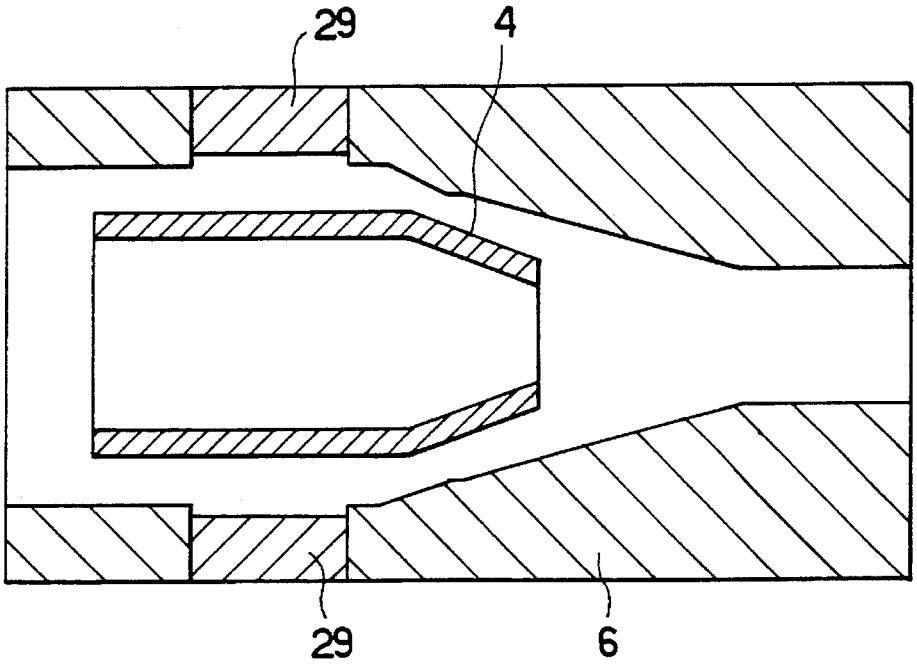
FIGS. 9 and 10 are longitudinal sections of a main portion, in enlarged scales, of a steam injector of a fourth embodiment of the present invention.

A third embodiment of the steam injector according to the present invention will be described hereunder with reference to FIGS. 7 and 8, in which the steam injector is incorporated with a needle valve 3 for adjusting the flow rate and other structure is similar to that of the first embodiment. In this third embodiment, the steam jetting nozzle 4 is fastened to the body 15 by means of bolts 19 through a press plate 18 and the seal ring 17 is interposed between the press plate 18 and the seal ring 17. The steam pressure can be adjusted by displacing the needle valve 3 in the steam jetting nozzle 4 to change its flow diameter. The needle valve 3 is moved by the operation of a handle 13 in the steam jetting nozzle 4 along a guide member 27 attached to the inside of the casing 2 by means of bolts 28.

According to this third embodiment, stable performance of steam injector can be attained and the reduction of the pressure loss results in the improvement of the performance of the steam injector. Furthermore, the mixing efficiency can be also improved by intentionally causing the turbulent flow of the steam.

A fourth embodiment of the steam injector according to the present invention will be described hereunder with reference to FIGS. 9 to 13, which show structures or portions of the steam injector necessary for this embodiment and in which other portions or structures which substantially correspond to those of the former embodiments are omitted.

Namely, in this fourth embodiment, the steam injector is provided with a control rib 29 at a portion, in which the steam flow likely stays, on the outside of the steam jetting nozzle 4 and the inside of the steam-water mixing nozzle 6.

Figure 10:
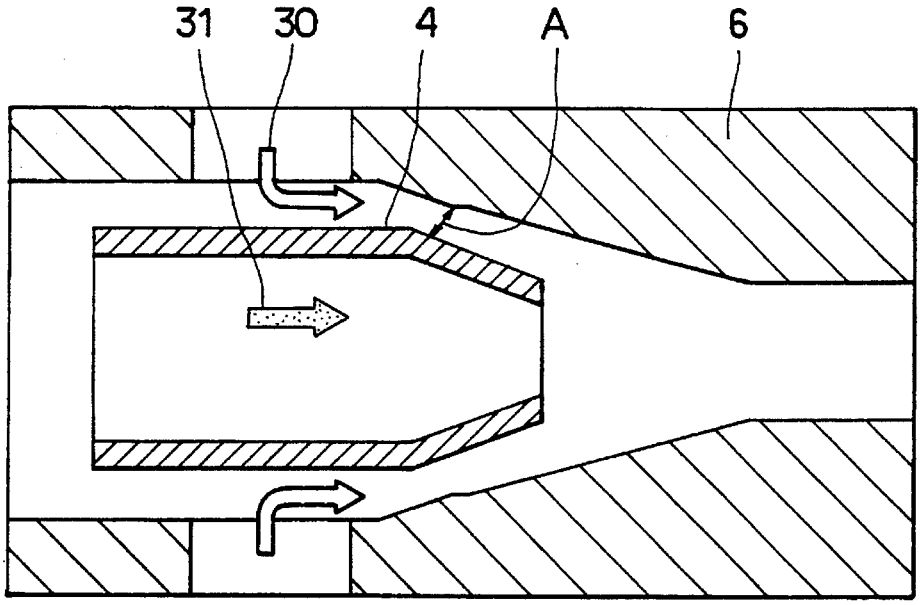

Referring to FIG. 10, on the operation start of the steam injector, a low-temperature supply water 31 flows in the steam jetting nozzle 4, and the supply water flow 31 is converted into the high-pressure steam flow due to the condensation of the low-pressure steam flow 30 inside the steam-water mixing nozzle 6. The converted steam flow is thereafter discharged on a downstream side. The steam flow is accelerated during passing through the most narrow area A between the steam jetting nozzle 4 and the steam-water mixing nozzle 6 and then blasted as a supersonic high-temperature steam flow.

Figure 11:
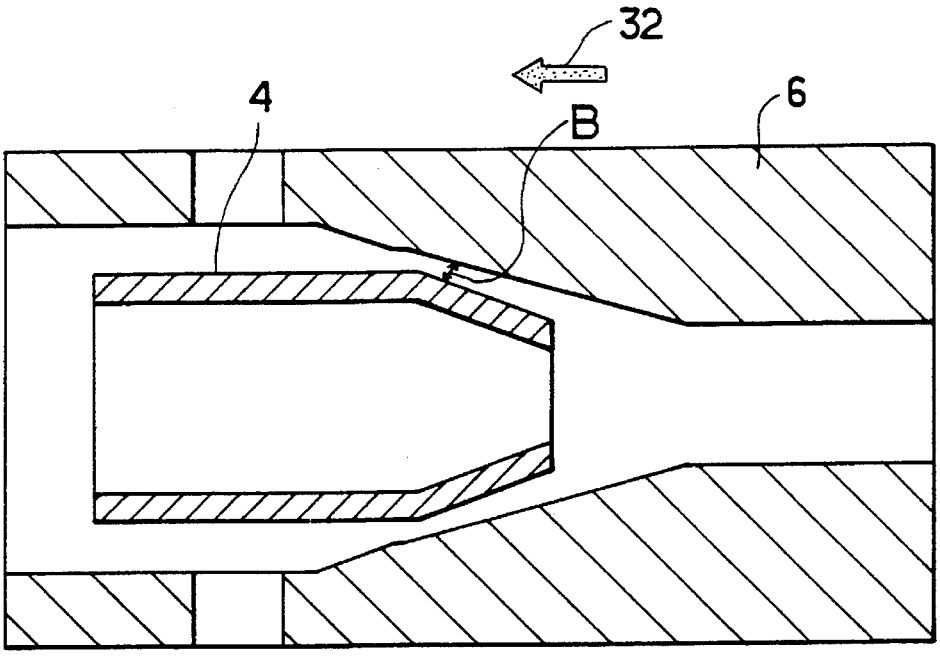
FIGS. 11 to 13 are views similar to that of FIG. 9 or 10 but are related to modified embodiments.
Figure 12:
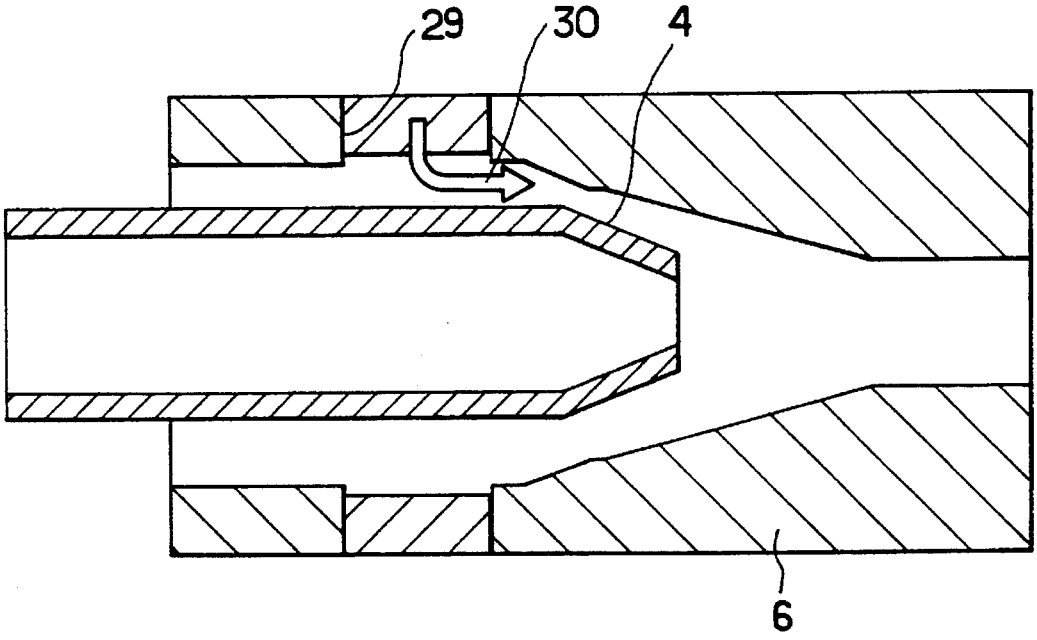
Figure 13:
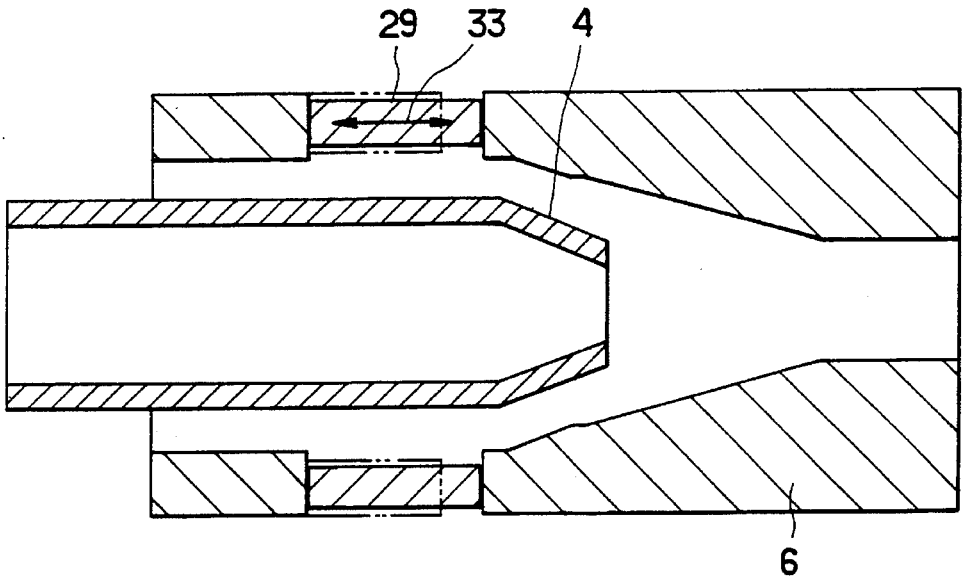

In this operation, as shown in FIG. 11, a gap is initially formed between the steam jetting nozzle 4 and the steam-water mixing nozzle 6 for maintaining the optimum operating condition. However, the flow passage is narrowed as shown by a letter B by the thermal expansion or deformation of the steam-water nozzle due to the temperature and pressure changes of the steam-water mixing nozzle 6 in response to the operation progress, thus changing the steam discharge amount. In order to prevent such phenomenon of deformation, the control rib 29 is arranged to the steam-water mixing nozzle 6 in this fourth embodiment as shown in FIGS. 12 and 13. Namely, when the temperature is changed after the operation start, the control rib 29 is first thermally expanded and deformed as shown by reference numeral 33 in FIG. 13 to thereby ensure the necessary flow area and to suppress the power change due to the deformation of the steam-water mixing nozzle 6.

In an alternation of this fourth embodiment, it may be possible to construct the steam injector body so as to be initially provided with the features of the control rib 29, and namely, there may be provided a body having a rigidity property for absorbing by itself the temperature and pressure changes of the steam-water mixing nozzle 6 during the operating period. Accordingly, it may be possible to construct the body so as to expand the gap between the steam jetting nozzle 4 and the steam-water mixing nozzle 6 in response to the operation progress of the steam injector, whereby the steam discharging performance can be controlled accordingly to improve the rapid startup. It is therefore necessary to form the control rib 29 with a material having a thermal expansion coefficient larger than that of a material of the nozzle portions. Four this purpose, it is desired to form the control rib of a material such as ferrite series low thermal expansion alloy or ceramics. In a modification, a springy structure may be adopted. In a case where it is desired to change the flow rate with time delay, it may be possible to utilize a high heat capacitance structure, for example, to utilize a closed loop coolant.

According to this fourth embodiment, it is made possible to constantly maintain the flow passage between the steam jetting nozzle 4 and the steam-water mixing nozzle 6 during a stable operation period after the operational start of the steam injector and also possible to adjust the power output and the operating conditions. These advantages or merits can be achieved by the movable structure of the steam jetting nozzle in this fourth embodiment. Accordingly, the deformation of the steam-water nozzle during the operation can be prevented without utilizing a complicated structure of the steam injector and stable operation can be also achieved with superior operational performance. This results in improvement of the reliability of the machinery or system utilizing the steam injector according to the present invention.

Figure 25:
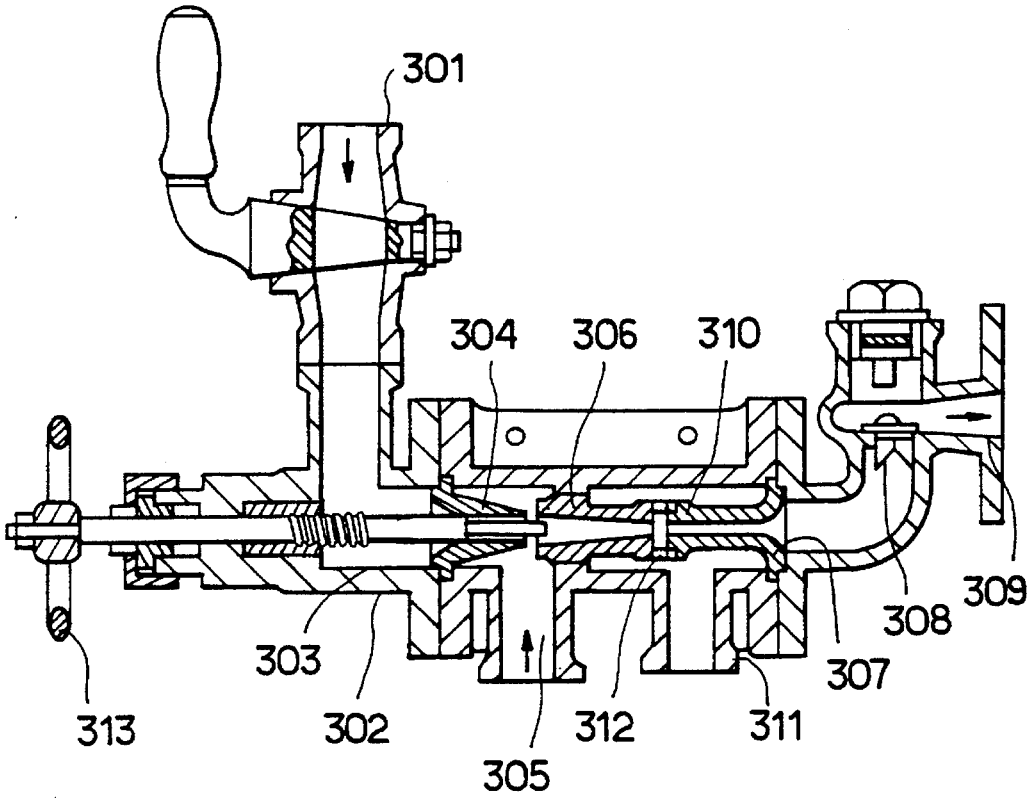
FIG. 25 PRIOR ART
FIGS. 25 to 28 are elevational and longitudinal sectional views of steam injectors according to the prior art .
Figure 26:
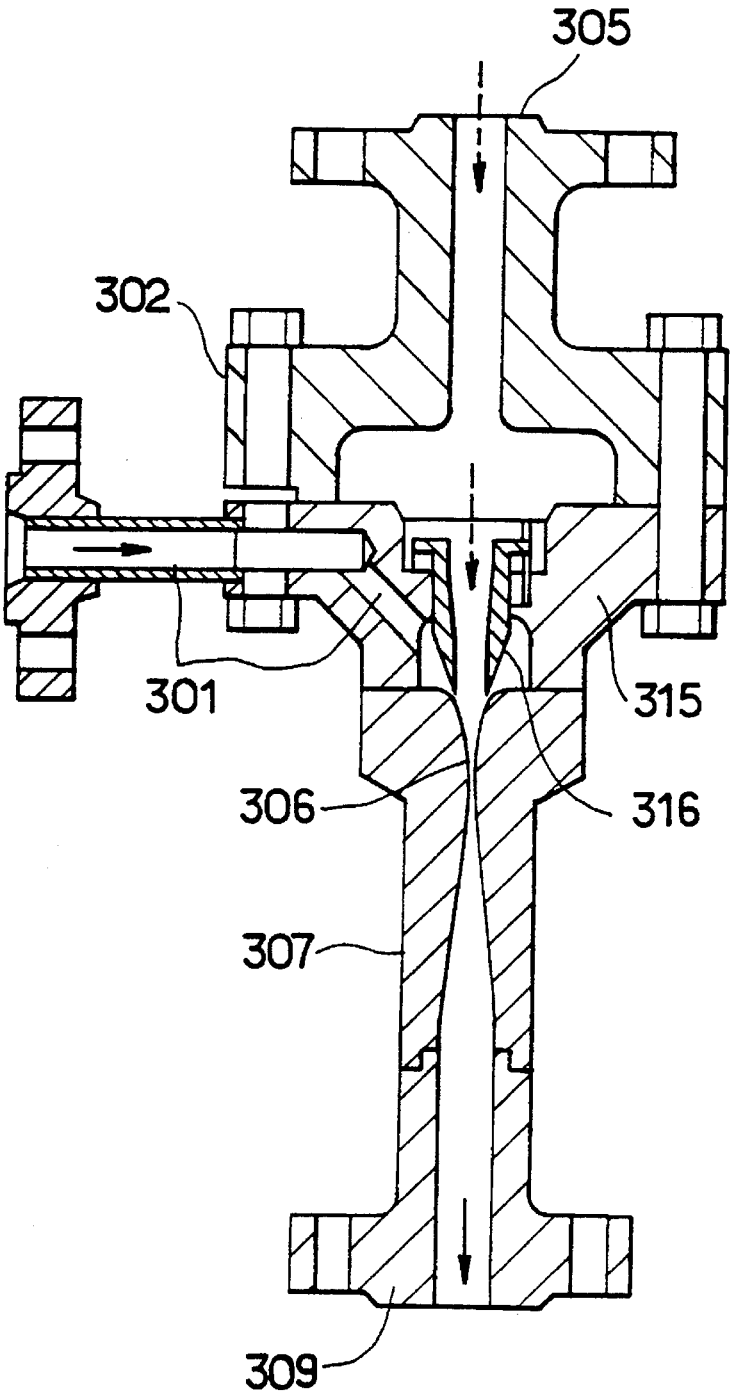
FIG. 26 PRIOR ART
Figure 27:
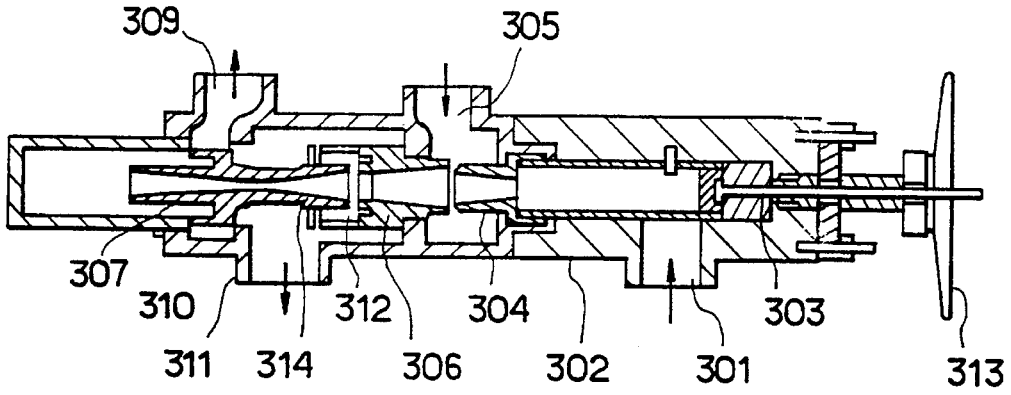
FIG. 27 PRIOR ART

A fifth embodiment of the steam injector according to the present invention will be described hereunder with reference to FIGS. 14 and 15, which is of a similar type to the steam injector of FIG. 25 in which a needle valve is incorporated, and the main differnce resides in the location of the steam jetting nozzle wall having a hollow portion or structure 115.

Figure 14:
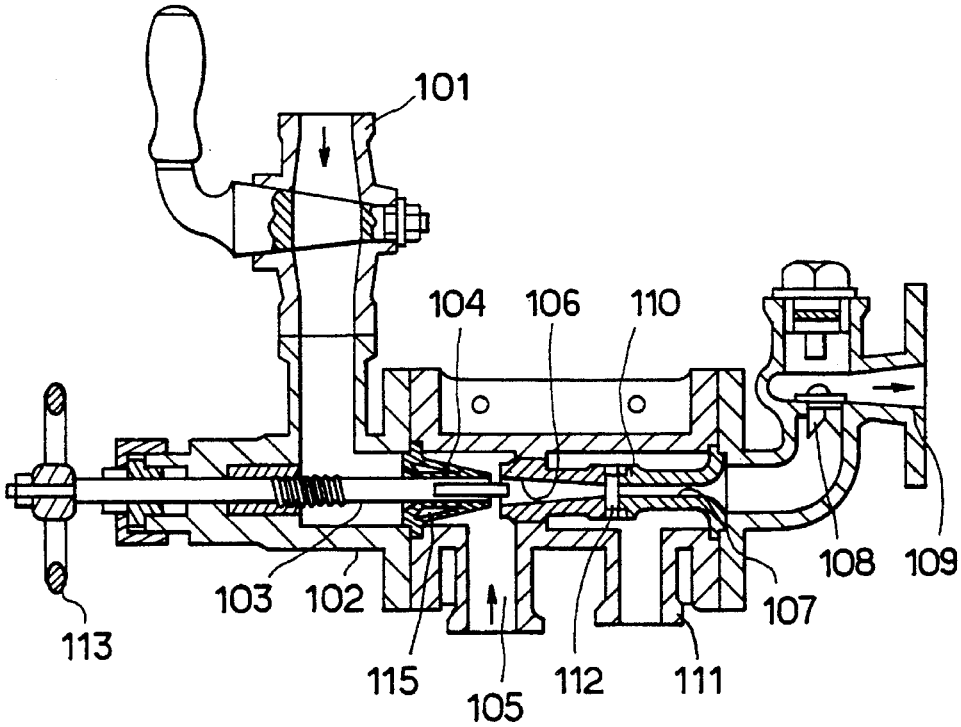
FIG. 14 shows a longitudinal section of a fifth embodiment of a steam injector according to the present invention.
Figure 15:
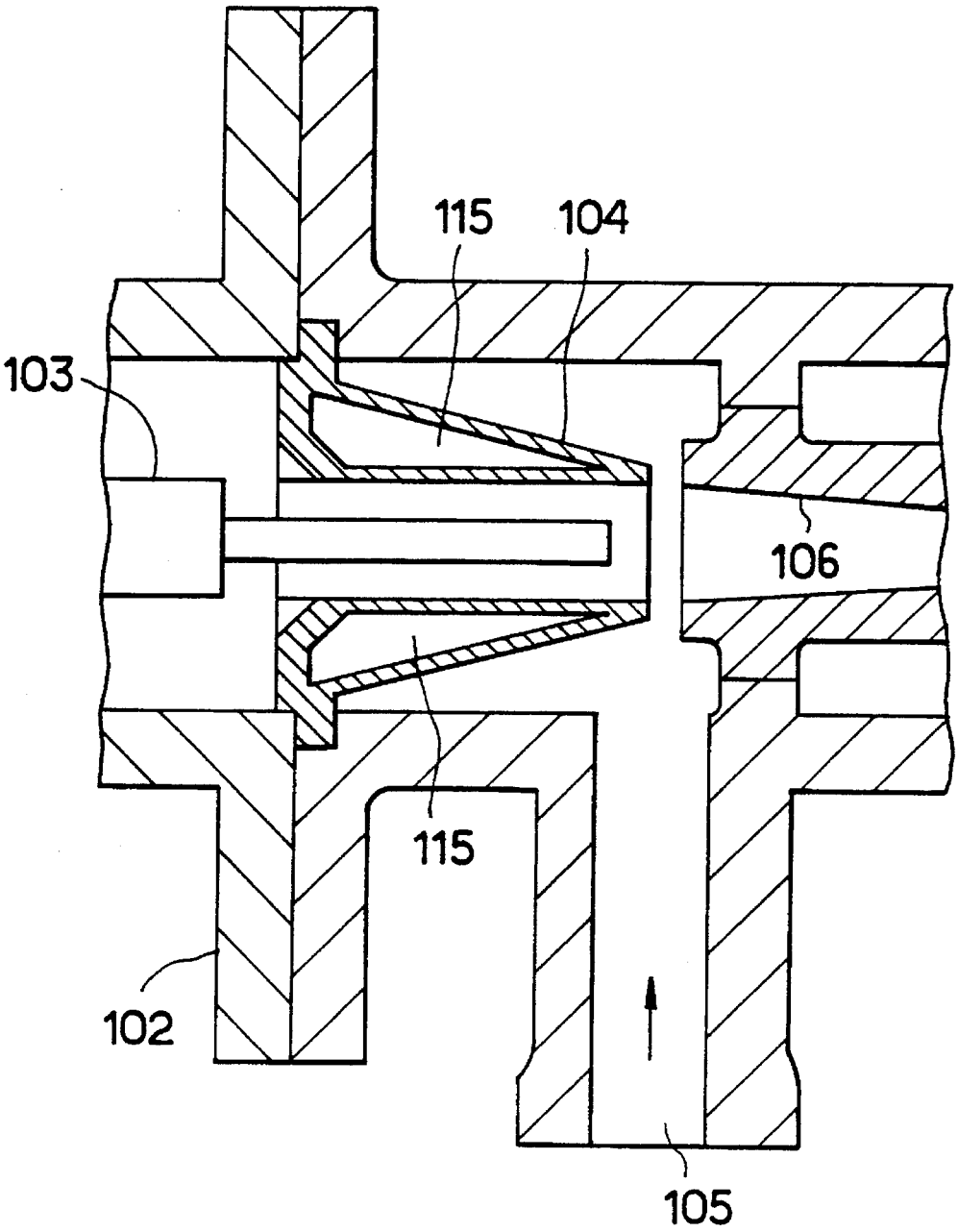
FIG. 15 is a longitudinal section of a main portion, in an enlarged scale, of the steam injector of FIG. 14.

Referring to FIGS. 14 and 15, a steam injector has a casing 102 having a steam intake port 101 and a steam jetting nozzle 104 incorporated with a needle valve 103 is disposed in the casing 102. A water suction port 105 is formed near the steam jetting nozzle 104, and a steam-water mixing nozzle 106 is arranged on the downstream side, right hand side as viewed, of the water suction port 105. A discharge port 108 is further provided for the casing 102 on a further downstream side of the steam-water mixing nozzle 106 through a diffuser 107 disposed for increasing the pressure of the steam. An overflow discharge port 112 is opened to a throat portion 109 of the diffuser 107. The steam jetting nozzle 104 is provided with a hollow wall portion 115 as a closed space structure so as to provide a so-called double wall structure.

In the steam injector of the structure described above, when the steam is supplied into the casing 102 through the steam intake port 101 and the needle valve 103 is withdrawn from the steam jetting nozzle 104 by the operation of a handle 113, the steam is jetted from the steam jetting nozzle 104, condensed by a low-temperature water sucked from the water suction port 105 and then flows into the steam-water mixing nozzle 106, thus forming a high velocity flow at the throat portion 110.

In this embodiment, a hollow portion or structure 115 is formed to the wall structure of the steam jetting nozzle 104. According to this structure, the heat transfer, through the wall structure of the nozzle, between the steam passing the steam jetting nozzle 104 and the water sucked from the water suction port 105 is substantially suppressed, thus significantly maintaining the temperature difference between the steam and the water both being mixed in the steam-water mixing nozzle 106.

According to this embodiment, since the heat is substantially not transferred from the steam to the water, the steam is not condensed in the steam jetting nozzle 104 and the flow velocity of the steam can be suitably maintained, thus reducing an excessive amount of the steam supply. Moreover, a temperature increasing in the supply water before the mixing with steam can be prevented, and the temperature difference at the mixing time can be properly maintained. Accordingly, the water is temperature not lowered unnecessarily, and the condensation of the steam in the steam-water mixing nozzle can be ensured, thus maintaining stable operation of the steam injector.

Figure 16:
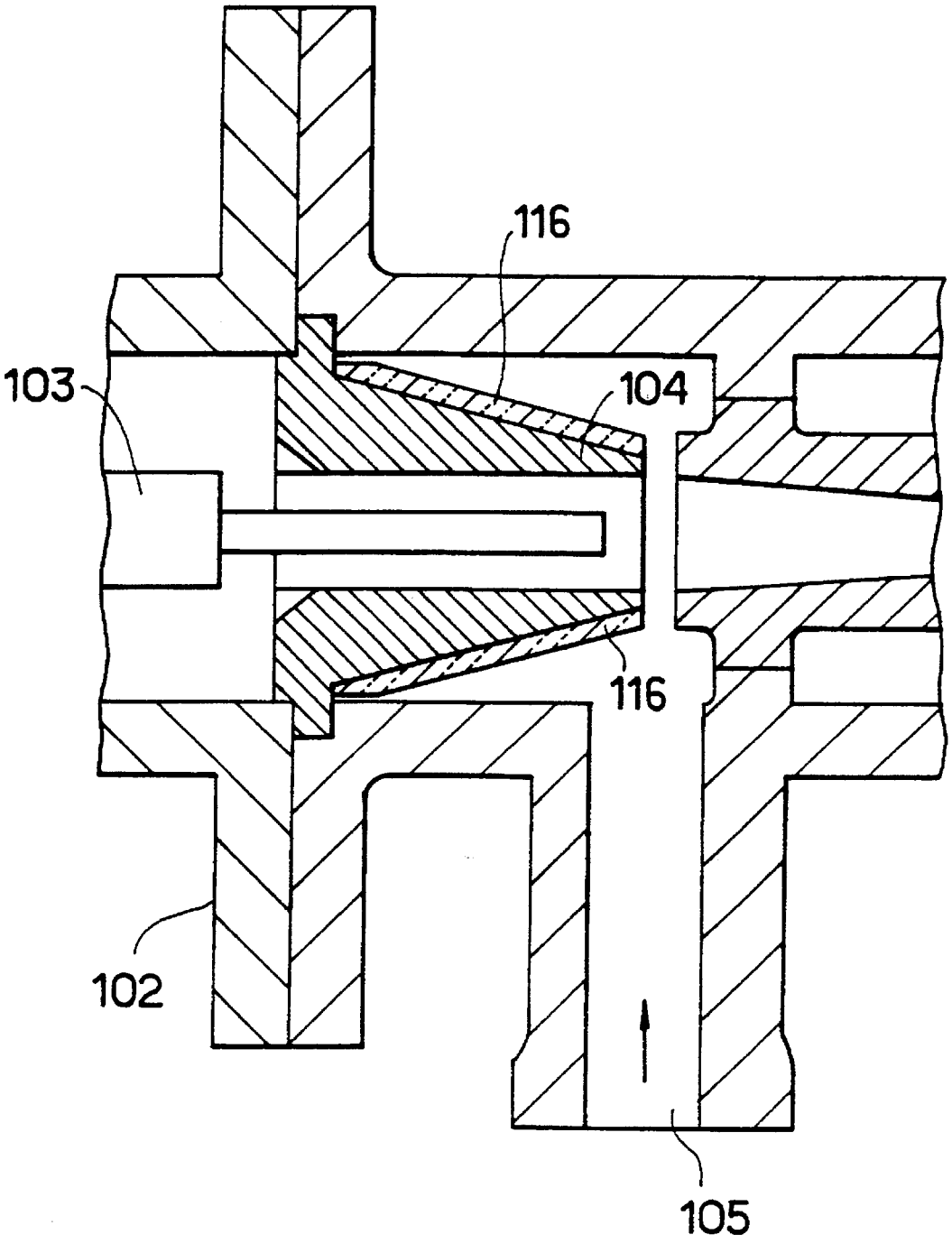
FIGS. 16 and 17 are views similar to that of FIG. 15, but are related to sixth and seventh embodiments of the present invention.
Figure 17:
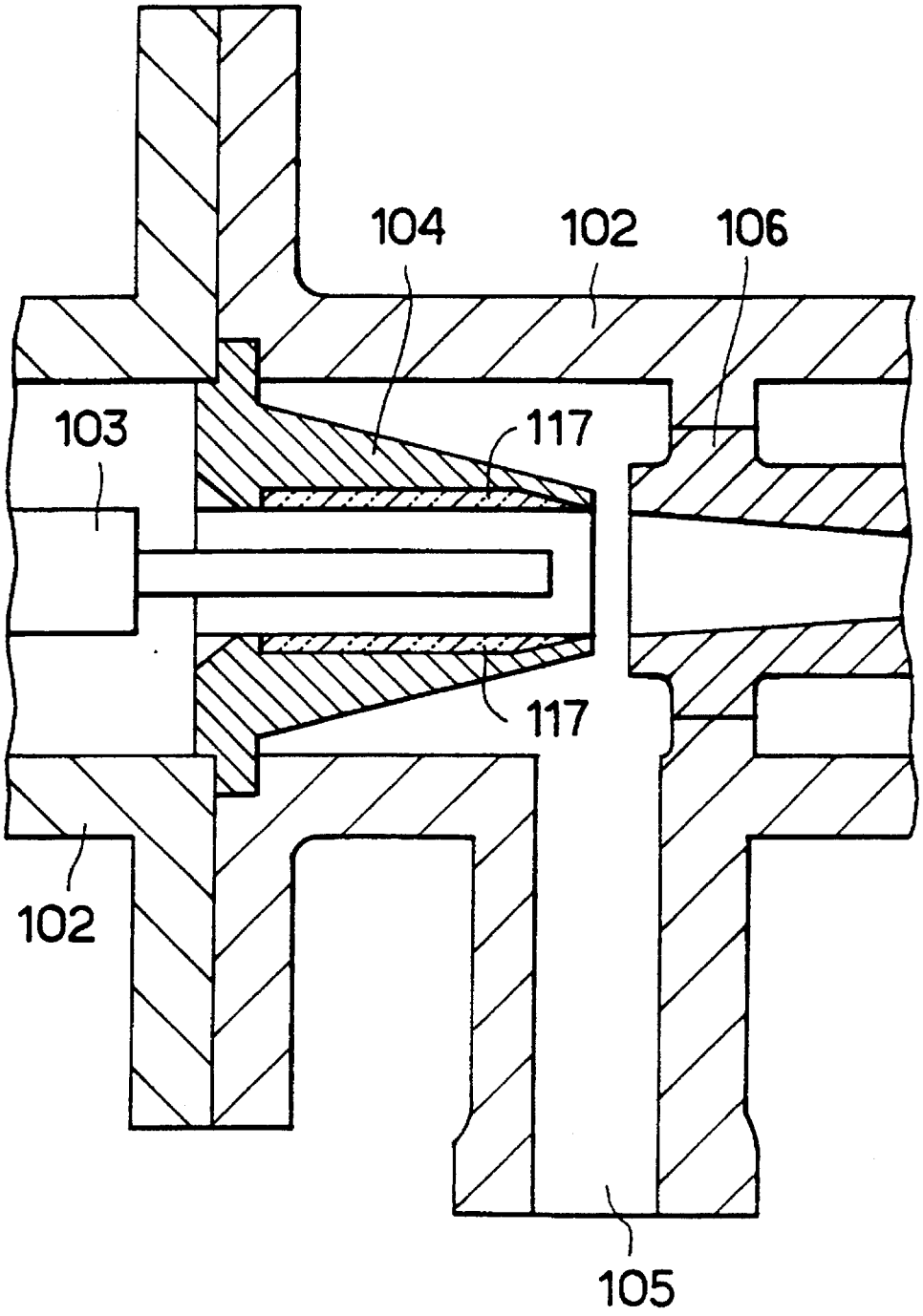

Sixth and seventh embodiments of the steam injectors according to the present invention will be further described hereunder With reference to FIGS. 16 and 17, which are similar to FIG. 14 and in which like reference numerals are added to portions or elements corresponding to those of the fifth embodiment.

In the sixth embodiment of FIG. 16, a wall structure member 116 is disposed on the outer surface of the steam jetting nozzle 104, and in the seventh embodiment of FIG. 17, a wall structure member 117 is disposed on the inner surface of the steam jetting nozzle 104. In a modified embodiment, these wall structure members 116 and 117 may both be provided for the steam jetting nozzle 104. It is desired to completely close the space by these wall structure members 116 and 117, but a slight gap may be allowed. For this purpose, it is desired to construct the wall structure members 116 and 117 with a material having a superior heat insulation property such as ceramics.

According to the sixth and seventh embodiments, substantially the same functions and effects can be expected when a condition of complete prevention of heat transfer is established, but in the case of the presence of the slight gap, the heat transfer between the steam and the water can be reduced in comparison with the metal material.

Furthermore, the wall structure of the steam jetting nozzle 104 may be made like to that of the conventional structure without providing any means such as hollow structure or wall structure members, but is formed of ceramics, which has coefficient of thermal conductivity remarkably smaller than that of a metal material to thereby attain a heat insulation effect.

According to the described embodiments, the wall structure of the steam jetting nozzle, which is usually formed of a metal material generally having highthermal conductivity, is formed so as to have a coefficient of thermal conductivity, is formed so as to have a hollow portion which is under a vacuum or in which a low-pressure gas is filled up for preventing heat transfer, or the wall structure may be formed as a honeycomb structure, whereby heat transfer can be prevented or limited. Accordingly, the temperature increasing in the steam jetting nozzle can preferably be prevented before condensation of the steam therein, whereby the temperature difference at the mixing time can be largely maintained, thus providing a steam injector having thigh performance and reliability.

Figure 18:
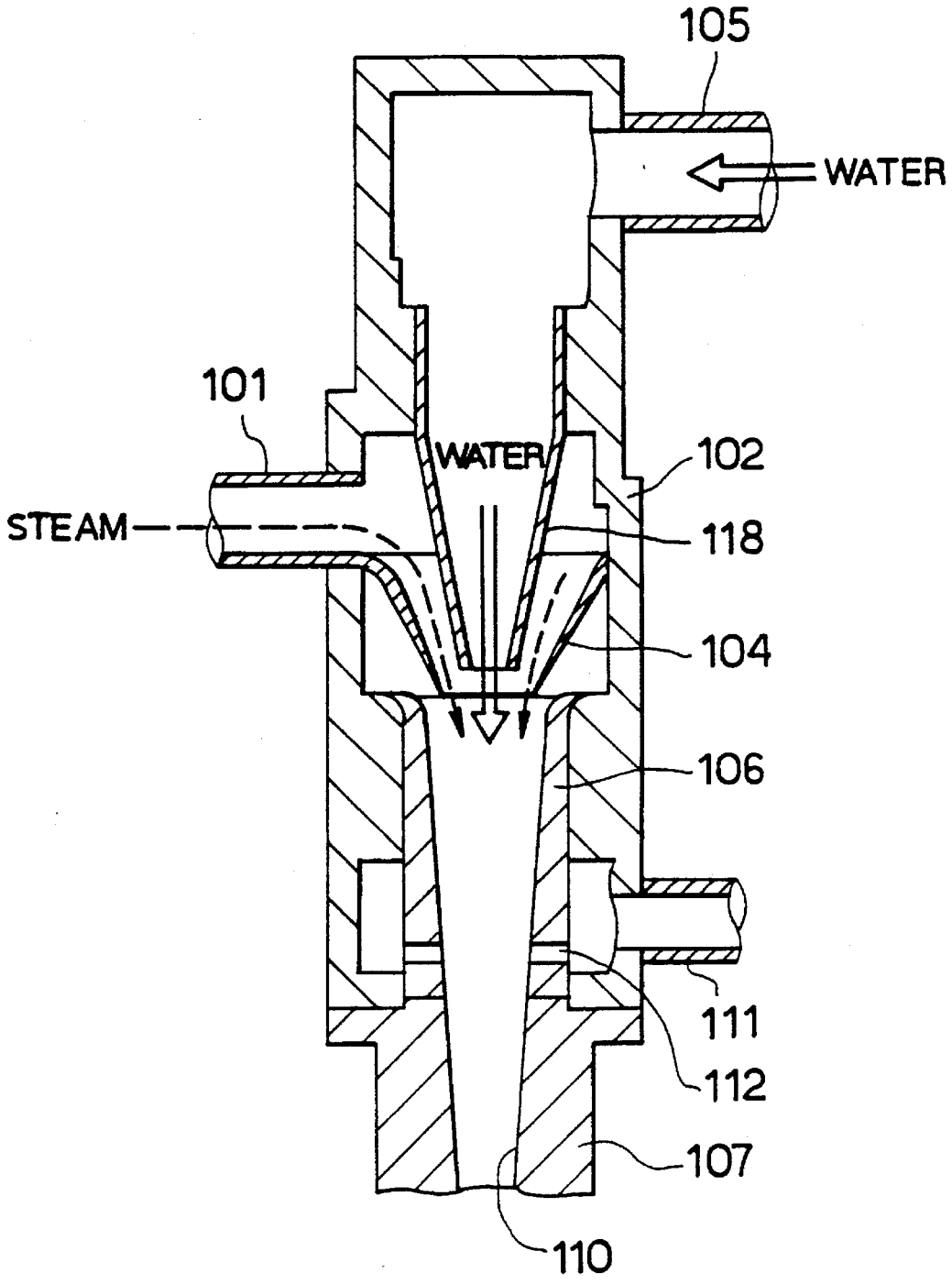
FIG. 18 shows an elevational section of an eighth embodiment of a steam injector according to the present invention.

An eighth embodiment of the steam injector according to the present invention will be further described with reference to FIGS. 18 and 19, in which a needle valve is not incorporated and in which like reference numerals are added to members or portions corresponding to those of FIGS. 14 and 15. In FIG. 18, a vertically arranged steam injector is illustrated, but this embodiment may be adapted for a horizontally arranged steam injector.

Referring to FIG. 18, the casing 102 is provided with the steam intake port 101, the water suction port 105.and an overflow discharge pipe 111, and within the casing 102 are disposed the steam jetting nozzle 104 and a star-shape water nozzle 118. The steam-water, mixing nozzle 106 is disposed on the discharge side of the steam jetting nozzle 104 and the water nozzle 118, and the diffuser 107 provided with the throat portion 110 is also arranged on the discharge side of the steam-water jetting nozzle 106. An overflow discharge port 112 is provided on the downstream side of the steam-water mixing nozzle 106. The overflow discharge port 112 and the overflow discharge pipe 111 are communicated with each other.

Figure 19A:
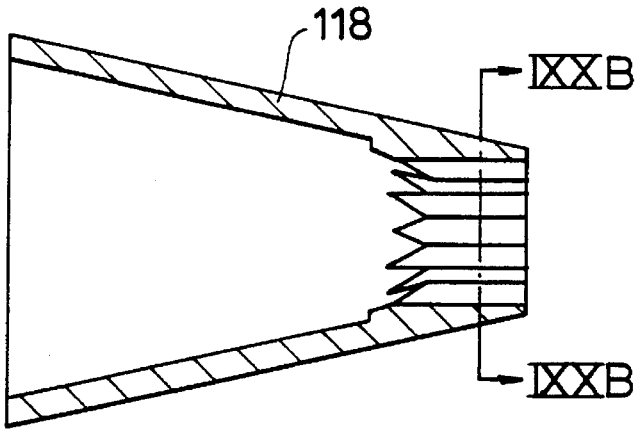
FIG. 19A is an illustrated section of a water nozzle of the steam injector of FIG. 18.
Figure 19B:
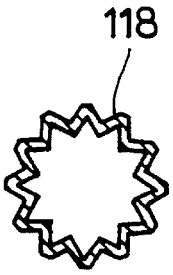
FIG. 19B is a section taken along the line IXXB—IXXB of FIG. 19A.

The star-shape water nozzle 118 is shown in FIGS. 19A and 19B and has a front, left hand as viewed, end formed in a star shape in a plan view. According to such star-shaped structure of the water nozzle 118, a hydraulic equivalent diameter is made small, and an area contacting the steam is increased because the surface of the water jet from the star-shape water nozzle 118 is bubbled, thus facilitating condensation of the steam. Accordingly, the pressure pulsation of the steam can be reduced by the location of the star-shaped water nozzle 118.

Figure 20A:
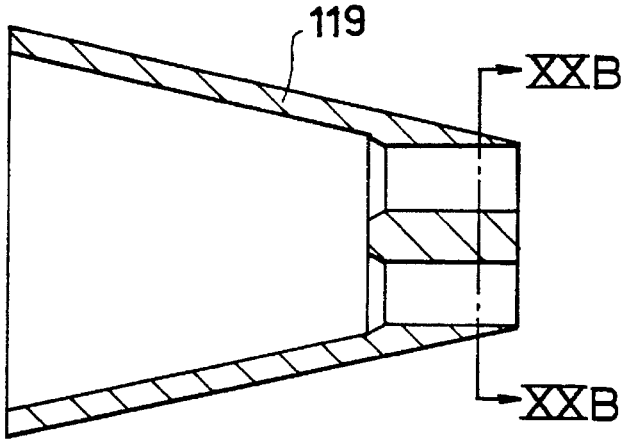
FIGS. 20A and 20B are views similar to those of FIGS. 19A and 19B but are related to a modification of the embodiment of FIGS. 19A and 19B.
Figure 20B:
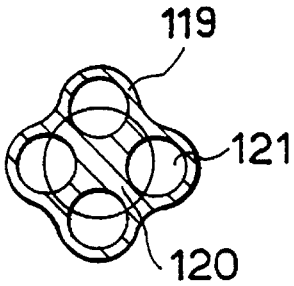

FIG. 20 shows a modified embodiment of FIG. 19, in which a multiple hole type water nozzle 119 is provided in place of the star-shaped water nozzle 118 of FIG. 19, and the multiple hole type water nozzle 119 is formed by forming a plurality, four in the illustrated embodiment, holes 121 by sectioning the front end of a conventional conical round type water nozzle by a sectioning member 120. The other structure of the steam injector of FIG. 20 is substantially the same as that of FIGS. 18 and 19.

According to this modified embodiment, the hydraulic equivalent diameter is reduced, and accordingly, the area contacting the steam is increased because the water jetted from the holes 121 of the water nozzle 119 are divided into four fine water jets, thus facilitating condensation. The pressure pulsation can be also reduced by arranging this multiple hole type water nozzle 119 to a portion at which a conventional water nozzle is arranged.

Figure 21:
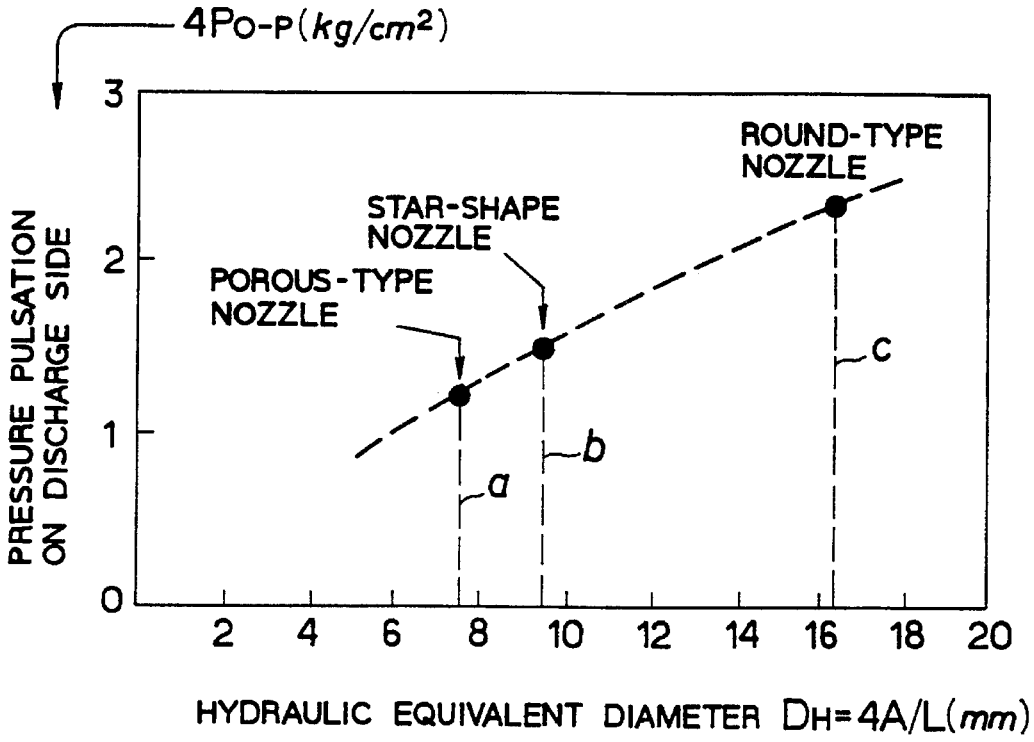
FIG. 21 is a graph showing characteristic features of the water nozzles of the present invention of FIGS. 19 and 20 in comparison with a conventional technique.

FIG. 21 shows a graph in which is shown experimental results in the usages of the star-shaped water nozzle and the multiple hole type water nozzle according to the present invention in which the hydraulic equivalent diameter is reduced in comparison with the conventional conical round type water nozzle. Referring to FIG. 21, the vertical axis represents pressure pulsation ($kg/cm^2$) and the horizontal axis represents a hydraulic equivalent diameter (mm). As can be seen from this graph, the pressure pulsation can be significantly reduced by about a half degree by forming the front end of the water nozzle so as to provide ,a star-shaped or multiple hole structure. In FIG. 21, letters a, b and c represent values of 7.6 mm, 9.5 mm and 16.2 mm, respectively, thus confirming the effectiveness of the present invention.

Figure 22:
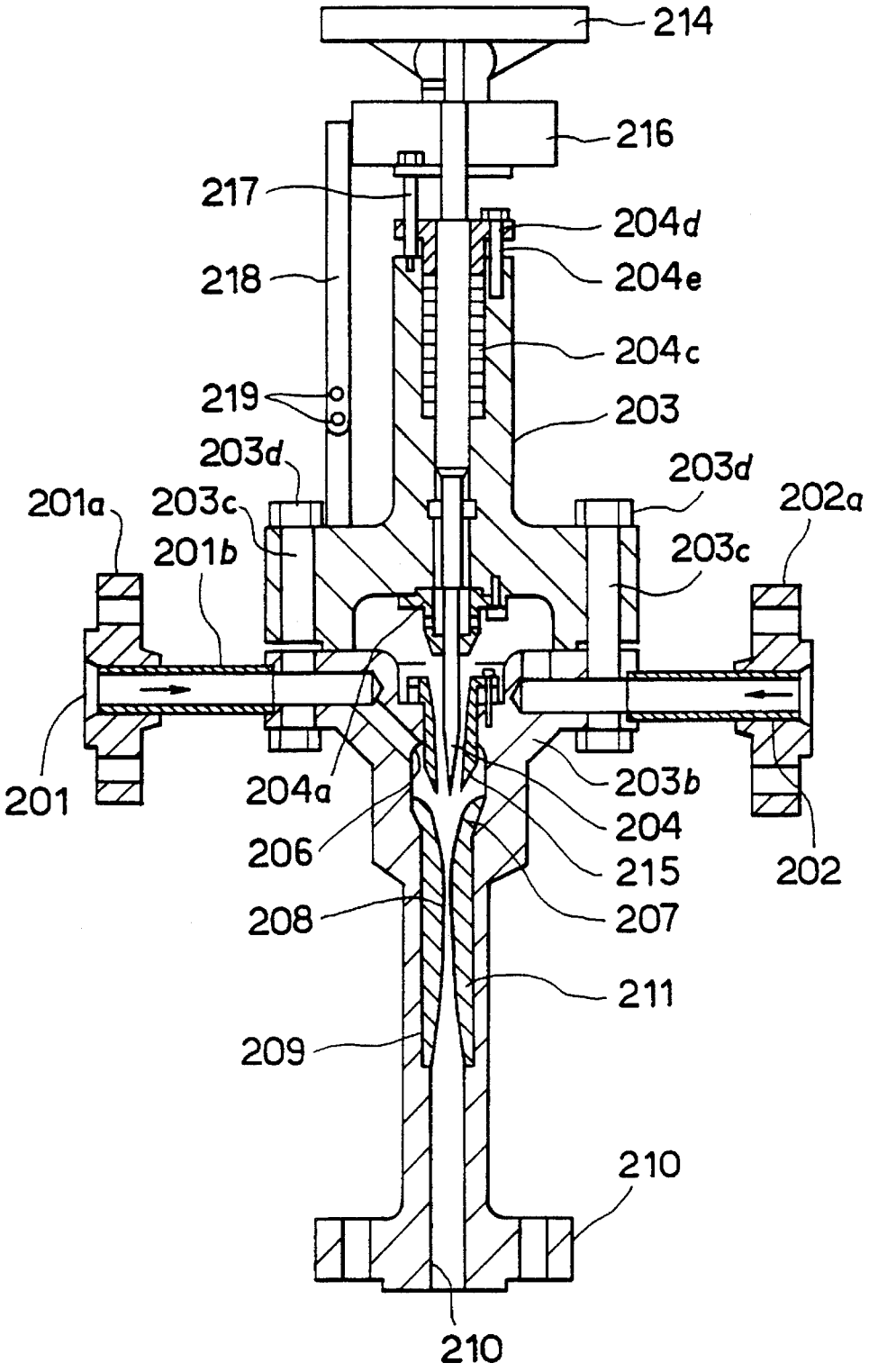
FIG. 22 shows an elevation section of a ninth embodiment of a steam injector according to the present invention.
Figure 23:
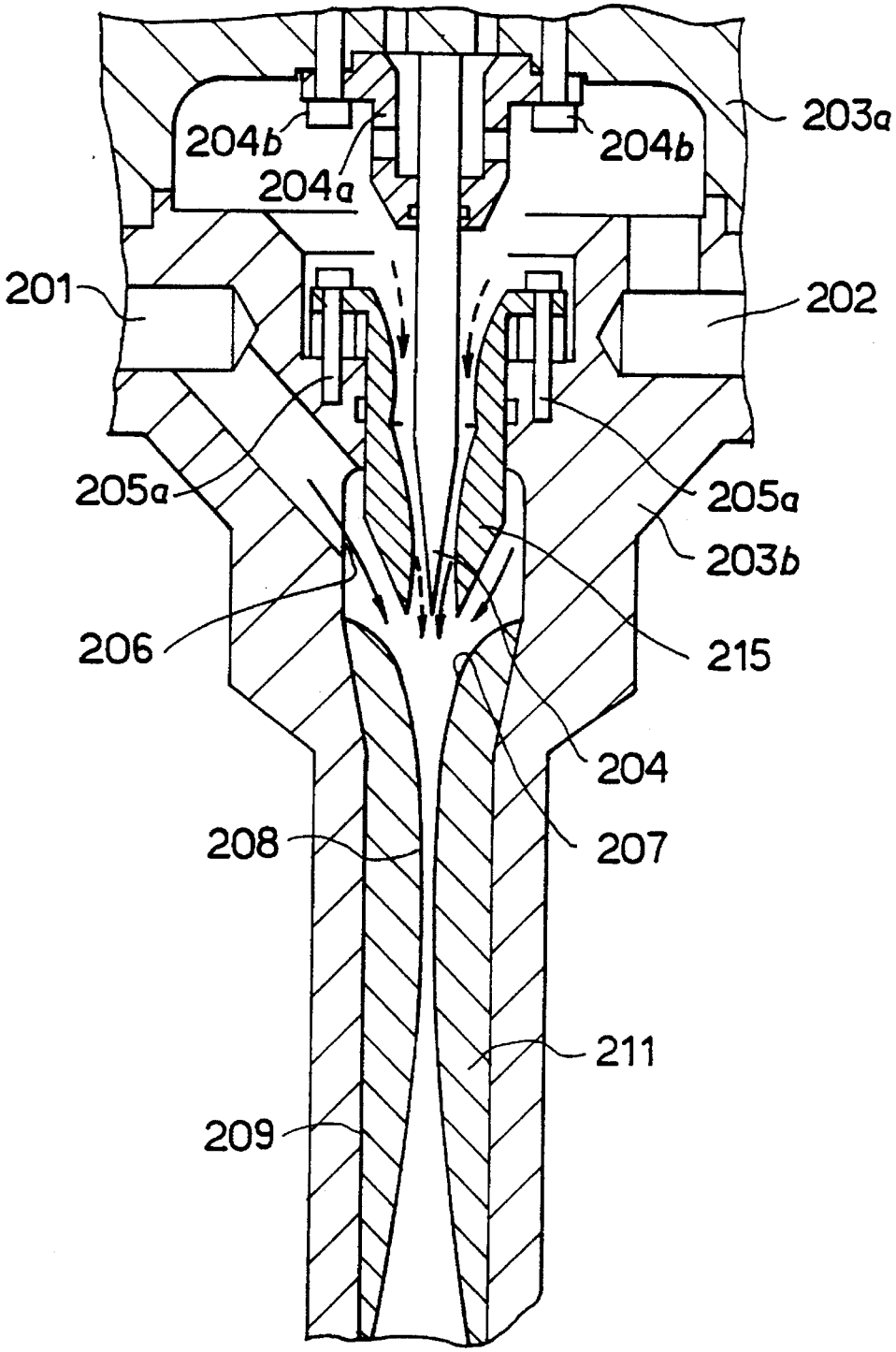
FIG. 23 is an elevational view of a main portion, in an enlarged scale, of the steam injector of FIG. 23.

In another aspect of the present invention, a ninth embodiment of the steam injector is shown in FIGS. 22 and 23. As can be seen from FIG. 22, the steam injector of this embodiment is of a type similar to that of FIG. 27, but arranged vertically, and a duplicate explanation of portions is now omitted as far as it is not concerned with the present embodiment.

Referring to FIGS. 22 and 23, in general, in an illustrated steam injector, a casing 203 is composed of an upper casing half 203*a* and a lower casing half 203*b*, and a steam intake port 201 and a water supply port 202 are formed to the lower casing 203*b*. The casing halves 203*a* and 203*b* are unitarily joined by means of bolt and nut assemblies 203*c* and 203*d*. The steam intake port 201 is formed a flanged portion 201*a* which is fastened to the lower casing 203*b* through a pipe 201*b*.

The water supply port 202 is formed in a attaching flanged portion 202*a* which is fastened to the lower casing 203*b*. In the upper casing 203*a*, a valve shaft 204*a* for supporting a needle valve 204 is fastened by means of bolts 204*b*. The needle valve 204 is connected to the water nozzle adjusting handle 214. A shaft seal 204*c* is disposed on the side surface of the needle valve 204 and the shaft seal 204*c* is pressed by a seal press cap 204*d*, which is fastened to the top portion of the upper casing 203*a*. A holder 216 is also mounted to the lower portion of the water nozzle adjusting handle 214, and the holder 216 is fastened to the top portion of the upper casing 203*a* by means of bolts 217 and also connected at one end therefore to a support rod 218. The front end of the support rod 218 is connected to the upper casing 203 through a pin 219. The steam supply nozzle 205 is fastened to the inner surface of the lower casing 203*b* by means of bolts 205*a*. The description of such constructions may be selectively applied to the embodiments described hereinbefore as illustrated in the respective figures.

Further referring to FIGS. 22 and 23, the needle valve 204 is disposed in the water supply nozzle 204. The steam jetting nozzle 206 is formed between the water supply nozzle 205 and the casing 203, and a steam-water mixing nozzle 207, a throat portion 208 and a diffuser 209 are disposed on the downstream side of the steam-water mixing nozzle 206. According to the present invention, in the steam injector of the structure described above, to the wall of the casing 203 forming the water supply nozzle 205 and the steam jetting nozzle 206 and to the surfaces of the steam-water mixing nozzle 207, the throat portion 208 and the diffuser 209 are formed wear resisting walls 211 formed of a wear resisting material such as ceramics, CRA (cobalt replaced alloy) or CFA (cobalt free alloy), and the water supply nozzle 205 is also formed of the wear resisting material of the kind described above.

According to the structure described above, although the steam supplied from the steam intake port 201 becomes supersonic flow on passing the steam jetting nozzle 206, wear caused by this supersonic flow can be suppressed or prevented since the water supply nozzle 205 is formed of the wear resisting material and the wear resisting wall structure 211 is adapted for the necessary flow portions in the casing 203. Thereafter, the water flow passing the steam-water mixing nozzle 207 reaches a high velocity water flow at the throat portion 208 and erosion will be hence caused at these portions, but the wear resisting walls 211 are formed on the inside of these steam-water mixing nozzle 207, the throat portion 208 and the diffuser 209, whereby the wear due to such erosion caused by the high velocity water flow can be preferably suppressed.

The steam injector having such wear resistant structure can be hence applied to a water supply device in an emergency core cooling system in a nuclear power plant requiring high reliability and high performance.

Figure 24:
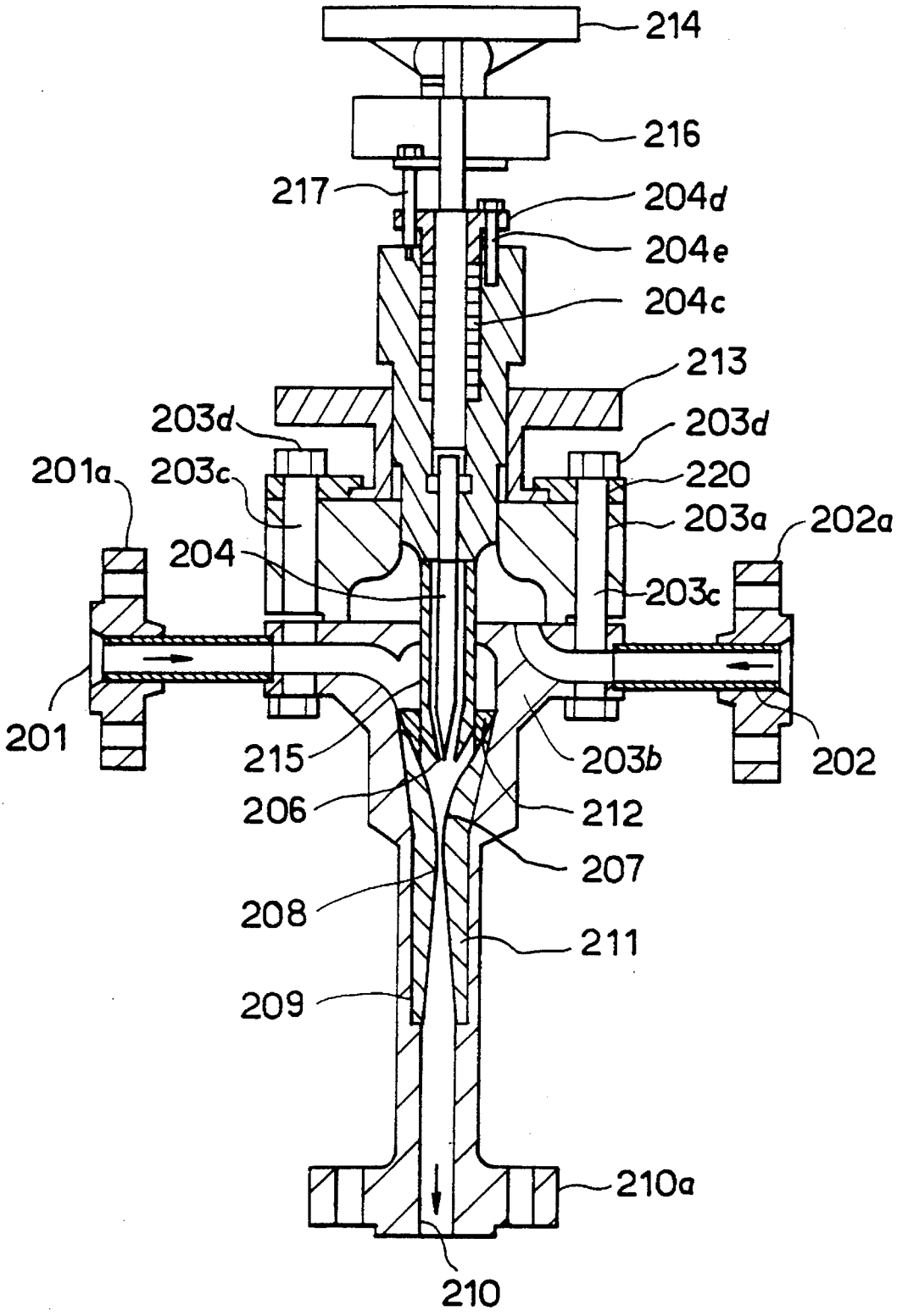
FIG. 24 is an elevational section similar to that of FIG. 22, but is related to a tenth embodiment according to the present invention.

FIG. 24 represents a tenth embodiment of the steam injector according to the present invention, in which like reference numerals are added to portions or members corresponding to those shown in FIG. 22.

In the embodiment of FIG. 24, there is provided a handle assembly 213 for adjusting the steam nozzle, which operates to vertically, i.e. axially, shift the water supply nozzle 215 to thereby control the steam flow area inside the casing 203. This steam nozzle adjusting handle assembly 213 is mounted to the upper casing 203*a* through a sheat plate 220 by means of bolt and nut assembly 203*c* and 203*d*.

Namely, this embodiment provides the steam injector in which the water supply nozzle 205 provided with the needle valve 204 is arranged to the lower casing 203*b* having the steam intake port 201, the steam jetting nozzle 206 is defined between the water supply nozzle 215 and the casing 203, and steam-water mixing nozzle 207 the throat portion 208 and the diffuser 209 are disposed on the downstream side of the steam jetting nozzle 206, and in such steam injector, the wear resisting wall structures are formed, of the wear resisting material such as ceramics, CRA or CFA, to the wall surfaces of the water supply nozzle 215 and the casing 203 forming the steam jetting nozzle 206 and also formed on the side of the steam-water mixing nozzle 207, the throat portion 208 and the diffuser 209. The water supply nozzle 205 is also formed of the described wear resisting material. A fin 212 is mounted to the steam jetting nozzle 206 for forming swivelling flow of the steam so as to prevent the water from contacting the wall surface at the steam-water mixing nozzle portion 207.

Although the steam constitutes a supersonic flow at a time when the steam fed from the steam intake port 201 passes the steam jetting nozzle 206, wear due to the supersonic flow of the seam can be prevented because the provision of the wear resisting wall structure of the water supply nozzle 205 and the casing 203. Furthermore, the steam constitutes a high velocity water flow at the throat portion 208 through the steam-water mixing nozzle 206, and in these portions, erosions are caused, but the wear resisting wall structures 211 are provided at the inside portions contacting the water flow of the steam-water mixing nozzle 207, the throat portion 208 and the diffuser 209, thus preventing the wear due to the erosion caused by the high velocity water flow.

Moreover, the steam passing the steam jetting nozzle 206 through the steam intake port 201 constitutes a swivelling flow at the steam-water nozzle 207 by the location of the fin 212, and the water fed from the water supply port 202 through the water supply nozzle 205 is also swivelled by the influence of such steam swivelling flow and mixed with the steam at the central portion thereof, thus obtaining the stable latent heat of the steam.

According to this tenth embodiment, the reliability of the steam injector can be enhanced by effectively preventing the wear and the performance thereof can be also improved by the swivelling flow of the steam, whereby the steam injector can be applied to a water supply unit of an emergency core cooling system of a nuclear reactor, for example, which requires high reliability with high performance.

It is to be noted that the present invention is not limited to the described preferred embodiments and many other changes or modifications may be made without departing from the scopes of the present invention. For example, the control rib 29 shown in FIG. 9 may be applied to the other embodiments, the hollow wall structure or wall structure member of FIGS. 15 and 16 may be applied to the other embodiments, and the water nozzle in FIG. 18 may be substituted by a the steam nozzle. Furthermore, many combinations of the respective embodiments may be also conceived in the present invention.

What is claimed is

1. A steam injector comprising:

a casing provided with a steam intake port and a water supply port;

a steam jetting nozzle disposed inside the casing so as to extend axially therein and communicated with the steam intake port for introducing steam into the casing;

a water nozzle disposed inside the casing, said water nozzle being communicated with the water supply port and introducing water into the casing;

a steam-water mixing nozzle disposed inside the casing and on a downstream side of the steam jetting nozzle and the water nozzle, said steam jetting nozzle having a front end facing the steam-water mixing nozzle;

a diffuser disposed inside the casing and on a downstream side of the steam jetting nozzle, said diffuser being provided with a throat portion; and a discharge port formed in the casing on a downstream side of the diffuser, wherein said water nozzle is disposed inside said steam jetting nozzle so as to provide a double structure with a hollow portion therebetween to realize a vacuum heat insulation state therein, and wherein said water nozzle has a front end with respect to a flow of water, said front end being formed so as to reduce a hydraulic equivalent diameter.

2. A steam injector according to claim 1, wherein a honeycomb member of an adiabatic material is arranged inside the hollow portion of the double structure.

3. A steam injector according to claim 1, wherein said front end of the water nozzle is star shaped in a plan view so as to increase a surface area contacting the steam.

4. A steam injector according to claim 1, wherein said front end of the water nozzle comprises a porous structure so as to increase a surface area contacting the steam.

* * * * *